US010625930B2

(12) United States Patent
Takahashi et al.

(10) Patent No.: US 10,625,930 B2
(45) Date of Patent: Apr. 21, 2020

(54) EJECTION MEMBER AND AEROSOL PRODUCT USING SAME

(71) Applicant: DAIZO CORPORATION, Osaka-shi Osaka (JP)

(72) Inventors: Tomoyuki Takahashi, Ibaraki (JP); Kazuhiro Matsui, Ibaraki (JP); Hidetoshi Miyamoto, Kyoto (JP); Satoshi Mekata, Osaka (JP)

(73) Assignee: DAIZO CORPORATION, Osaka (JP)

( * ) Notice: Subject to any disclaimer, the term of this patent is extended or adjusted under 35 U.S.C. 154(b) by 0 days.

(21) Appl. No.: 16/073,308

(22) PCT Filed: Jan. 27, 2017

(86) PCT No.: PCT/JP2017/003046
§ 371 (c)(1),
(2) Date: Jul. 26, 2018

(87) PCT Pub. No.: WO2017/131197
PCT Pub. Date: Aug. 3, 2017

(65) Prior Publication Data

US 2019/0047777 A1 Feb. 14, 2019

(30) Foreign Application Priority Data

Jan. 29, 2016 (JP) ..... 2016-016537
May 25, 2016 (JP) ..... 2016-103887
Jul. 4, 2016 (JP) ..... 2016-132357

(51) Int. Cl.
*B65D 83/30* (2006.01)
*B65D 83/68* (2006.01)
(Continued)

(52) U.S. Cl.
CPC ..... *B65D 83/303* (2013.01); *B05B 1/14* (2013.01); *B65D 83/30* (2013.01); *B65D 83/48* (2013.01);
(Continued)

(58) Field of Classification Search
CPC ..... B65D 83/303; B65D 83/68; B65D 83/30
See application file for complete search history.

(56) References Cited

U.S. PATENT DOCUMENTS 5,813,785 A 9/1998 Baudin et al.
2010/0062096 A1* 3/2010 Clauwaert ..... B65D 83/20 425/376.1
(Continued)

FOREIGN PATENT DOCUMENTS

CN 103097261 A 5/2013
JP H02-045161 U 3/1990
(Continued)

OTHER PUBLICATIONS

Search Report issued in corresponding International Patent Application No. PCT/JP2017/003046, dated Mar. 21, 2017.
(Continued)

*Primary Examiner* — Jeremy Carroll
(74) *Attorney, Agent, or Firm* — McDermott Will & Emery LLP

(57) ABSTRACT

Provided are an ejection member and an aerosol product using the same capable of obtaining a desired shape of an ejection material by suppressing adhesion of the ejection ejection materials to each other. An ejection member to be connected to an aerosol container filled with a foaming content is provided with an expansion chamber for promoting foaming of the foaming content from the aerosol container and a plurality of nozzles for ejecting the foaming content in the expansion chamber to the outside. The expan-
(Continued)

sion chamber is provided with an introduction port for introducing the foaming content from the aerosol container and a delivery port for delivering the foaming content to the nozzle side. The nozzles each have a slit-shaped ejection port. The communication path that communicates the ejection port and the delivery port has a slit-shaped slit portion. A length of the slit portion in the ejection direction is greater than a slit width of the ejection port.

26 Claims, 12 Drawing Sheets

(51) Int. Cl.

| | |
|---|---|
| ***B05B 1/14*** | (2006.01) |
| ***B65D 83/48*** | (2006.01) |
| ***B65D 83/14*** | (2006.01) |
| *B65D 83/46* | (2006.01) |

(52) U.S. Cl.
CPC ..... *B65D 83/68* (2013.01); *B65D 83/753* (2013.01); *B65D 83/46* (2013.01)

(56) References Cited

U.S. PATENT DOCUMENTS

| | | | | |
|---|---|---|---|---|
| 2013/0175305 | A1 | 7/2013 | Ohshima | |
| 2013/0206869 | A1 * | 8/2013 | Ravazzoni | B05B 1/1645 239/442 |
| 2016/0302624 | A1 | 10/2016 | Little | |

FOREIGN PATENT DOCUMENTS

| | | | | | |
|---|---|---|---|---|---|
| JP | 09183469 | A | * | 7/1997 | B65D 83/26 |
| JP | H09-183469 | A | | 7/1997 | |
| JP | 2006-325981 | A | | 12/2006 | |
| JP | 2006325981 | A | * | 12/2006 | |
| JP | 2008-001381 | A | | 1/2008 | |
| JP | 4499257 | B2 | | 7/2010 | |
| JP | 2013-240759 | A | | 12/2013 | |
| JP | 2014-234186 | A | | 12/2014 | |
| JP | 2014234186 | A | * | 12/2014 | |
| JP | 2016-010919 | A | | 1/2016 | |
| JP | 2016010919 | A | * | 1/2016 | |
| JP | 2016-540695 | A | | 12/2016 | |
| WO | 2005048966 | A1 | | 6/2005 | |

OTHER PUBLICATIONS

First Office Action issued in Chinese Application No. 201780008567.5, dated Jul. 19, 2019, with English translation.

The Extended European Search Report dated Sep. 2, 2019 for the related European Patent Application No. 17744427.0.

* cited by examiner

EJECTION MEMBER AND AEROSOL PRODUCT USING SAME

CROSS REFERENCE

This application is the U.S. National Phase under 35 U.S.C. § 371 of International Application No. PCT/JP2017/003046, filed on Jan. 27, 2017, which claims the benefit of Japanese Application No. 2016-016537, filed on Jan. 29, 2016, Japanese Application No. 2016 103887, filed on May 25, 2016, Japanese Application No. 2016-132357, filed on Jul. 4, 2016 the entire contents of each are hereby incorporated by reference.

TECHNICAL FIELD

The present invention relates to an ejection member for ejecting a foaming content into a desired formed shape and an aerosol product using the ejection member.

BACKGROUND ART

As an ejection member for controlling an ejection shape of a foaming content, for example, Patent Documents 1 and 2 can be exemplified. The ejection member described in Patent Document 1 has a spatula-shaped nozzle and is configured to eject a foaming content in a band shape. The ejection member described in Patent Document 2 is provided with a cup-shaped side wall and a cup-shaped control portion provided at the center of the side wall, and is configured to eject a forming content along the inner peripheral surface of the side wall and the outer peripheral surface of the control portion to thereby eject the foaming content while forming into a cylindrical shape.

PRIOR ART DOCUMENT

Patent Document

Patent Document 1: Japanese Examined Patent Publication No. 4499257

Patent Document 2: Japanese Unexamined Patent Application Publication No. 2013-240759

SUMMARY OF THE INVENTION

Problems to be Solved by the Invention

In the meantime, the ejection material (foam) ejected from the ejection member described in Patent Documents 1 and 2 has a relatively simple shape and is not necessarily excellent in design properties. Under the circumstances, it is conceivable to provide a plurality of ejection holes in the ejection member to create an ejection material having high design properties imitating a flower, an animal, a character, or the like.

However, simply providing a plurality of ejection holes causes adhesion of the ejection materials ejected from the respective ejection holes, which makes it difficult to obtain a desired shape.

Under the circumstances, the present invention aims to provide an ejection member capable of obtaining foam molded into a desired shape by suppressing adhesion between ejection materials, and to provide an aerosol product using the ejection member.

Means for Solving the Problems

An ejection member according to the present invention is an ejection member 20, 20A, 20B, 20C, 20D, 20E, 20F, 20G, 20H, 20J to be connected to an aerosol container 10, 40, 41, 50 filled with a foaming content, including a body provided with an expansion chamber E for encouraging foaming of the foaming content C1, C2 from the aerosol container 10, 40, 41, 50, and a plurality of nozzles 22*c* rising from the body and configured to eject the foaming content C1, C2 in the expansion chamber E to an outside, wherein the expansion chamber E is provided with an introduction port 21*e* for introducing the foaming content C1, C2 from the aerosol container 10, 40, 41, 50 and a delivery port 22*b* for delivering the foaming content C1, C2 to a nozzle 22*c* side, the nozzles 22*c* each have a slit-shaped ejection port 22*d*, a communication path that communicates the ejection port 22*d* with the delivery port 22*b* has a slit-shaped slit portion 22*e*, and a length L1 of the slit portion 22*e* in an ejection direction is greater than a slit width W1 of the ejection port 22*d*.

The slit portion 22*e* is preferable formed in a tapered shape that narrows toward the ejection direction. Alternatively, the slit portion 22*e* is preferably formed in a tapered shape that expands toward the ejection direction.

A baffle 21*f*, 23*a*, 27, 71 is preferably provided opposing to the delivery port 22*b* with a gap therebetween.

A tip end surface of the nozzle 22*c* is preferably inclined with respect to the ejection direction. It is preferable that an outer surface of the nozzle 22*c* be formed in a tapered shape that narrows toward a tip end and that a tapered surface continuously extends to the ejection port 22*d*.

The nozzles 22*c* are preferably different in height from each other.

The ejection port 22*d* is preferably curved in a direction orthogonal to the ejection direction.

The plurality of nozzles 22*c* is preferably spirally arranged.

The nozzles 22*c* preferably decrease in height sequentially toward a center.

A gap S is preferably provided between radially adjacent nozzles 22*c*, 22*c*.

The slit width W1 of the ejection port 22*d* is preferably non-uniform.

The communication path is preferably curved or inclined toward an inside.

A cut 22*g* is preferably provided at a tip end of the nozzle 22*c* along the ejection direction.

The nozzle 22*c* preferably protrudes toward an expansion chamber E side.

The nozzle 22*c* lower in height among the plurality of nozzles 22*c* preferably protrudes toward the expansion chamber E side.

It is preferable that the expansion chamber E be partitioned into partitioned spaces 30, 31, 80, 81 and that the introduction port 21*e*, 71*a* and the delivery port 22*b* be provided in each of the partitioned spaces.

It is preferable that a drain hole 21*h* be provided in the expansion chamber E. In addition, it is preferable to provide a closing member 90 configured to close the drain hole 21*h* when in use and open the drain hole 21*h* when not in use.

It is preferable that the expansion chamber E be formed only when in an inverted state.

It is preferable that a central axis 100 of a substrate portion 22*a* which is a foundation of the plurality of nozzles 22*c* be shifted from a central axis 101 of a connecting portion 21*a* to be connected to a stem 12*a* of the aerosol container 10.

An aerosol product according to the present invention includes an aerosol container 10, 40, 41, 50 filled with a foaming content C1, C2, and the ejection member 20 20A, 20B, 20C, 20D, 20E, 20F, 20G, 20H, 20J of the present invention attached to the aerosol container.

Effects of the Invention

Since the ejection member of the present invention has an expansion chamber, the foaming content will foam in the expansion chamber, which makes it possible to suppress additional foaming of the foaming content (ejection material) ejected to the outside from the nozzle. Further, since the nozzle has a slit-shaped ejection port, the communication path that communicates this ejection port with the delivery port has a slit-shaped slit portion, and the length of the slit portion in the ejection direction is greater than the slit width of the ejection port, the foaming content will be ejected from the ejection port so as to be molded into a slit-shape in the slit portion and pushed up, and therefore the foam shape is less likely to collapse. Therefore, it is possible to suppress adhesion between ejection materials ejected from different nozzles, which makes it easy to obtain foam molded into a desired shape. Further, since the surface area of the ejection material increases, it is easy to diffuse the active ingredients contained in the content.

In cases where the slit portion is formed in a tapered shape that narrows toward the ejection direction, the foaming content once expanded in the expansion chamber will be ejected from the nozzle in such a way that it is gradually compressed, and therefore the shape of the foam is less likely deformed. For this reason, it is possible to suppress adhesion between ejection materials ejected from different nozzles, which makes it easy to obtain foam molded into a desired shape.

When the slit portion is formed in a tapered shape that expands toward the ejection direction, the resistance at the slit portion is suppressed, and therefore the foaming content in the expansion chamber is more easily ejected to the outside from the nozzle.

When a baffle opposing to the introduction port with a gap therebetween is provided, it is possible to suppress ejecting of the content not foamed sufficiently. As a result, additional foaming after ejection can be suppressed, which can suppress adhesion between ejection materials.

When the tip end of the nozzle is inclined with respect to the ejection direction, the ejection material ejected to an object such as a palm can be easily separated from the nozzle, which makes it possible to apply the ejection material on an object and suppress collapse of the shape of the ejection material.

When the outer surface of the nozzle is formed in a tapered surface that narrows toward the tip end and the tapered surface is continuous to the ejection port, the tip end of the nozzle becomes thinner, which facilitates separation of the ejection material from the nozzle (foam separation).

Also when the nozzles are different in height from each other, the ejection material ejected to an object such as a palm can be easily separated from the nozzle, which makes it possible to apply the ejection material on an object and suppress collapse of the shape of the ejection material.

When the ejection port is curved in a direction orthogonal to the ejection direction, since the ejection material rises in a curved manner, the ejection material itself becomes easier to stand by itself as compared with the case in which the ejection material is simply ejected in a form of a flat plate. Therefore, it is possible to suppress adhesion between ejection materials, which in turn can obtain an ejection material excellent in design properties using a curved shape.

When a plurality of nozzles is spirally arranged, foam can be formed in a substantially concentric circular shape, which in turn can obtain an ejection material having excellent design properties.

Furthermore, when the nozzles decrease in height toward the center, the ejection material is molded in a predetermined shape also in the height direction so that the center rises, and therefore it is more excellent in design properties. Further, since the heights of the nozzles are different, the ejection material ejected to an object such as a palm can be easily separated from the nozzle.

When a gaps is formed between adjacent nozzles in the radial direction, adhesion between ejection materials can be suppressed, which makes it easy to create an air gap between ejection materials.

When the slit width of the ejection port is non-uniform, the ejection amount and the speed of the ejection material ejected from the ejection port can be adjusted, which can form foam different in height in the ejection direction.

When the communication path is curved or inclined inwardly, the upper end of the ejection material ejected to an object such as, e.g., a palm can be inclined toward the outside, so that the ejection material opened outward as a whole can be obtained.

When a cut is provided at a tip end of the nozzle along the ejection direction, a streak can be made on the surface of the ejection material.

When the nozzle protrudes toward an expansion chamber side, the length of the slit portion in the ejection direction can be increased. For this reason, it is possible to make the shape of the ejection material ejected from the nozzle is less likely to collapse, which makes it easier to obtain an ejection material of a desired shape.

When a nozzle lower in height among the plurality of nozzles protrudes toward the expansion chamber side, it is possible to suppress collapse of the shape of the ejection material ejected from the nozzle whose height is low while exerting the effect that the ejection material can be easily separated from the nozzle, which in turn can obtain a better shaped ejection material.

When the expansion chamber is partitioned into partitioned spaces and the introduction port and the delivery port are provided in each of the partitioned spaces, by communicating aerosol containers different in content with respective introduction ports, it is possible to eject different kinds of contents at the same time.

When a drain hole is provided in the expansion chamber, even if water enters the expansion chamber when rinsing the ejection member for example, drainage can be easily performed. When a closing member configured to close the drain hole when in use and open the drain hole when not in use, there occurs no leakage of the content from the drain hole when in use.

When the expansion chamber is formed only when in an inverted state, no expansion chamber is formed in the upright position, that is, when not in use, so that no water will accumulate in the expansion chamber.

When a central axis of a substrate portion which is a foundation of the plurality of nozzles is shifted from a central axis of a connecting portion to be connected to a stem of the aerosol container, in a state in which the ejection member is attached to the aerosol container, the overhang of the ejection member from the aerosol container on the side opposite to the shifted direction can be reduced. Therefore, when operating the ejection member with an index finger or a middle finger while holding the aerosol container with a thumb, a ring finger, and a little finger, the warping of the index finger or the middle finger can be suppressed, so the ejection member can be easily operated.

BRIEF DESCRIPTION OF THE DRAWINGS

FIG. 7A is a cross-sectional view thereof, and FIG. 7B and FIG. 7C are plan views thereof.

FIG. 8A is a cross-sectional view thereof, FIG. 8B is a plan view thereof, and FIG. 8C is a perspective view thereof.

FIG. 9A is a cross-sectional view thereof, and FIG. 9B is a plan view thereof.

FIG. 10A is a cross-sectional view thereof when not in use, and FIG. 10B is a cross-sectional view thereof when in use.

FIG. 11A is a cross-sectional view thereof when not in use, and FIG. 11B is a cross-sectional view thereof when in use.

EMBODIMENTS FOR CARRYING OUT THE INVENTION

Figure 1A:
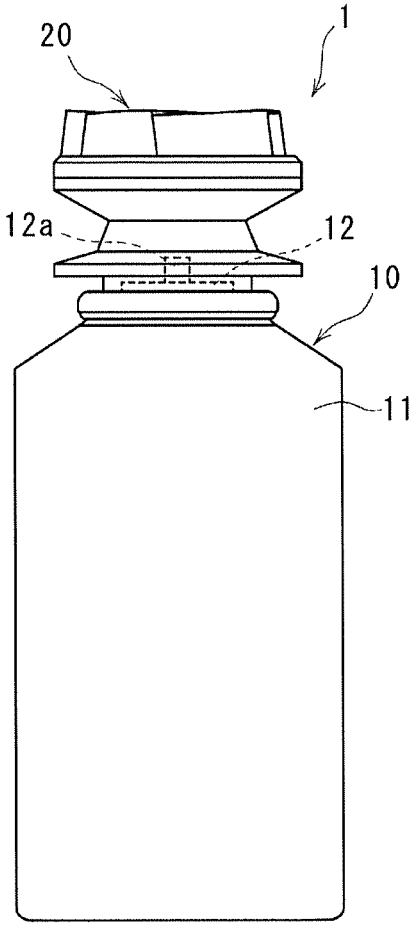
FIG. 1A is a side view showing an embodiment of an aerosol product of the present invention.

Next, aerosol products of the present invention will be described in detail based on the drawings. As shown in FIG. 1A, the aerosol product 1 of the present invention is composed of an aerosol container 10 and an ejection member 20 attached to the aerosol container 10.

First, the aerosol container 10 will be described. The aerosol container 10 is configured by attaching a valve assembly 12 to a bottomed cylindrical container 11, and an effervescent content (aerosol composition) consisting of a concentrate and a liquefied gas is filled therein. The concentrate and the liquefied gas are emulsified by a surfactant in the aerosol container 10. When they are ejected to the outside, the liquefied gas is vaporized and the concentrate foams into foam. Such content is preferable such that the concentrate is 60 to 97 mass %, the liquefied gas is 3 to 40 mass %, more preferably the concentrate is 70 to 95 mass % and the liquefied gas is 5 to 30 mass %. When the liquefied gas is less than 3 mass %, the foam to be formed becomes watery, resulting in deteriorated formability and shape retainability of the foam. When the liquefied gas is more than 40 mass %, the density of the foam to be formed is small, resulting in deteriorated shape retainability of the foam. Further, foaming tends to continue even after being ejected, and therefore the shape of the molded foam tends to collapse. Note that for the purpose of improving the separation of foam from the ejection member 20 (the nozzle 22*c* to be described later) or adjusting the foam quality by increasing the momentum of ejection, a compressed gas, such as, e.g., a carbon dioxide gas, a nitrous oxide, and nitrogen, may be added.

As the concentrate, it is preferable to use a solution in which a surfactant is added to a solvent for the purpose of forming foam. As such a surfactant, a nonionic surfactant, an anionic surfactant, a cationic surfactant, an amphoteric surfactant, a silicone type surfactant, an amino acid surfactant, or the like are preferably used. Further, an anionic surfactant, an amino acid surfactant, or the like may be added as it is possible to form good quality foam having hardness and elasticity which is easily molded into a predetermined shape by the ejection member 20 (slit portion 22*e* which will be described later). Further, a water-soluble polymer, such as, e.g., a cationic polymer, gelatin, and hydroxyethyl cellulose, may be added. Further, for the content, as an active component, a fragrance component such as a perfume, a deodorizing component, a bactericidal component, a cleaning component, a moisturizing component, an insecticidal component, a pest repellent component, etc., are arbitrarily contained. The hardness of the foam is preferably 300 to 3,000 (mN), particularly preferably 400 to 2,500 (mN). The hardness of the foam can be measured as follows: foam is ejected from an aerosol product adjusted to 25° C. to a bottomed cylindrical cup (inner diameter: 32 mm, depth: 27 mm) to fill the cup with the foam; and the foam is compressed with a disc of a diameter of 30 mm at a speed of 60 (mm/min) by applying a load to the foam in the cup. The hardness is the value (breaking point) when the load greatly changes with respect to the compression amount due to the rupture of the foam. When the hardness of the foam itself is smaller than 300 (mN), there is a tendency that it is difficult to be molded into a predetermined shape even though it passes through the slit portion 22*e*, and when it is larger than 3,000 (mN), there is a tendency that it is less likely to be formed into a delicate shape.

Further, as a property of foam which gives a cushioning feeling and a glutinous feeling when applied to a skin, the elasticity of foam at 25° C. is adjusted to 300 to 2,000 (N/mm), and preferably 400 to 1,500 (N/mm). When the elasticity is less than 300 (N/mm), the foam becomes less likely to give a cushioning feeling. On the other hand, when the elasticity exceeds 2,000 (N/mm), the foam becomes less likely to spread and stretch. The elasticity of the foam can be measured in the same manner as the hardness as follows: foam is ejected from an aerosol product adjusted to 25° C. to a bottomed cylindrical cup (inner diameter: 32 mm, depth: 27 mm) to fill the cup with the foam; and the foam is compressed with a disc of a diameter of 30 mm at a speed of 60 (mm/min) by applying a load to the foam in the cup. The elasticity is the value of the repulsive force receiving from the foam.

Next, the ejection member 20 will be described. The ejection member 20 is composed of a base portion 21 to be attached to a stem 12*a* of the aerosol container 10 and a nozzle portion 22 to be mounted on the base portion 21. Note that a quantitative unit capable of supplying a constant amount of a foaming content to an expansion chamber E may be provided between the stem 12*a* and the base portion 21. This makes it easier to mold foam into a stable shape.

A cylindrical connecting portion 21*a* to be connected to the stem 12*a* is provided at a lower position of the base portion 21. A cylindrical cover portion 21*b* is provided so as to cover the outer periphery of the connecting portion 21*a*. From the cover portion 21*b*, a flange portion 21*c* extends outward in the radial direction. It should be noted that this flange portion 21*c* functions as a finger hook for pushing the ejection member 20 downward when operating the stem 12*a* of the aerosol container 10.

At the upper portion of the base portion 21, a shallow cup-shaped body 21*d* is provided. When the upper portion of the cup-shaped body 21*d* is covered with a substrate portion 22*a* of the nozzle portion 22 which will be described later, the expansion chamber E is formed inside thereof. In this state, it can be said that the body having the expansion chamber E is formed by the base portion 21 and the substrate portion 22*a* of the nozzle portion 22. The volume V of the expansion chamber E is preferably set so that the value of the volume V (unit: ml) of the expansion chamber E/the maximum cross-sectional area $A_{max}$ (unit: $cm^2$) of the expansion chamber E is 0.1 to 1. For example, when the diameter of the expansion chamber is 3 cm, the cross-sectional area of the horizontal cross-section is approximately 7.07 $cm^2$, so the volume V is preferably 0.7 to 7 ml. When the value of $V/A_{max}$ is smaller than 0.1, foaming of the content in the expansion chamber E becomes insufficient, resulting in foaming even after the ejection, which causes easy collapse of the shape. When the value of $V/A_{max}$ is larger than 1, foam is continuously ejected from the nozzle portion 22 even after the ejection material is adhered to an object, and therefore the foam is likely to adhere to the nozzle portion 22. Further, the content is likely to remain in the expansion chamber E.

Further, the ejection rate (ejection speed) D of the foaming content to be supplied to the expansion chamber E is preferably 0.5 to 2 (ml/sec). Note that this ejection amount is obtained by measuring the weight (g/sec) of the foaming content ejected from the stem of the aerosol container stem per second and converting the liquid density of the foaming content into a volume assuming that the foaming content ejected from the stem is in a liquid state. In particular, when the volume of the expansion chamber E is V (unit: ml), it is preferable to set so that DN is 0.05 to 0.5. For example, when the volume of the expansion chamber E is 4 ml, the ejection rate is preferably 0.2 to 2 (ml/sec). When the D/V is less than 0.05, the outer peripheral portion of foam tends to become small and therefore it becomes difficult to mold into a desired shape. When it is larger than 0.5, the foaming content will be ejected through the ejection port in a state in which the foaming content is not sufficiently foamed in the expansion chamber. Thus, the shape of the foam tends to easily collapse.

At the bottom portion of the cup-shaped body 21*d*, an introduction port 21*e* is provided. The introduction port 21*e* is communicated with the connecting portion 21*a* and configured to introduce the content from the aerosol container 10 into the expansion chamber E. A disc-shaped baffle 21*f* is provided opposing to the introduction port 21*e* to block the introduction port 21*e* with a gap therebetween. This baffle 21*f* has a diameter larger than the diameter of the introduction port 21*e* and is attached to the cup-shaped body 21*d* by three ribs 21*g* radially provided in a plan view (see FIG. 2).

The nozzle portion 22 is composed of a disk-shaped substrate portion 22*a* and a plurality of nozzles 22*c* protruding upward from the substrate portion 22*a*.

Figure 1B:
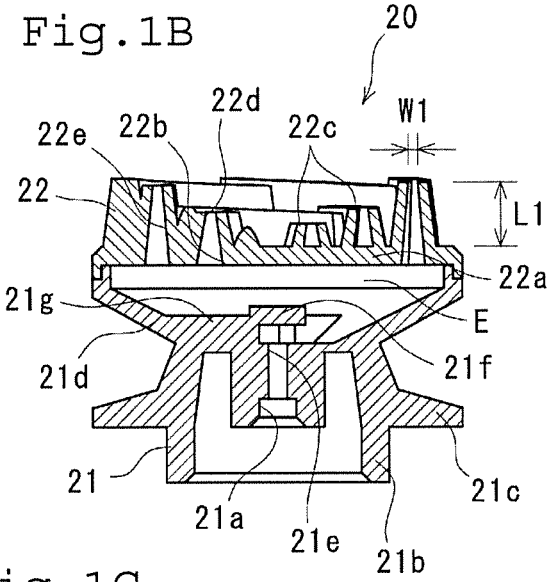
FIG. 1B is a cross-sectional view of an ejection member.
Figure 1C:
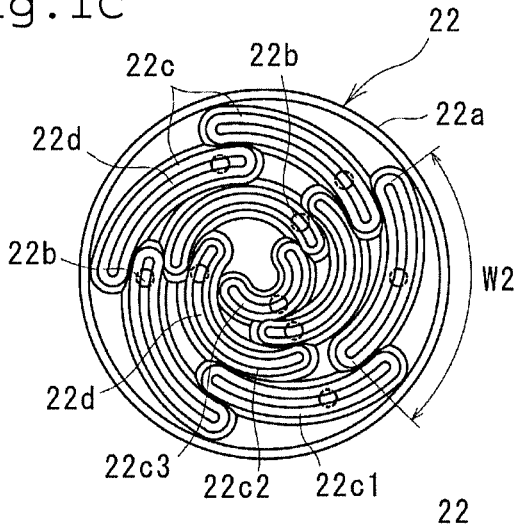
FIG. 1C and FIG. 1D are plan views of the ejection member.
Figure 1D:
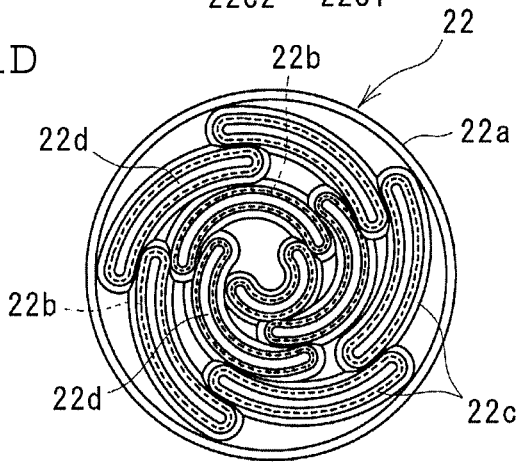

As shown in FIG. 1C, the nozzle 22*c* has a flat plate shape curved in a circular arc in a direction (in-plane direction) orthogonal to the ejection direction of the content in a plan view, and has a slit-shaped ejection port 22*d* at the upper end portion of the nozzle. Further, as shown in FIG. 1B, a delivery port 22*b* for delivering the content from the expansion chamber E into the nozzle 22*c* is provided in the substrate portion 22*a*. The communication path that communicates the delivery port 22*b* and the ejection port 22*d* has a slit portion 22*e* formed to a slit-shape curved in a plan view in a part thereof, specifically, in the nozzle 22*c*. The slit portion 22*e* has the same shape (similar shape) as the ejection port 22*d*. Further, in a side view, the communication path is formed in a tapered shape that narrows toward the ejection port 22*d* (toward the ejection direction) (see FIGS. 1B and 1C. Describing specifically, the area of the flow passage at the lower end of the slit portion 22*e* is the largest, and the area of the flow passage becomes smaller as it approaches the ejection port 22*d*. The opening area of the ejection port 22*d* is the smallest. Note that the inclination angle of the taper is constant.

Further, the length L1 of the slit portion 22*e* in the ejection direction (vertical direction) is larger than the slit width (width in the lateral direction) W1 of the ejection port 22*d*, preferably twice or more, more preferably 3 times or more the slit width W1. The slit width W1 described here denotes the narrowest width at the slit portion 22*e*, and the length L1 of each nozzle is larger than the respective slit widths W1. Note that the communication path of the substrate portion 22*a* is formed in a shape in which a tip end of a cone is cut out in order to adjust the supply amount from the expansion chamber E to the nozzle 22*c*. However, it may be formed in a cylindrical shape. In the slit width direction (the short direction of the slit), It seems that the taper of the discharge port 22*d* extends downward by the communication path of the substrate portion 22*a*. In the longitudinal direction of the slit, as shown in FIG. 1C, the communication path of the substrate portion 22*a* is smaller than the ejection port 22*d*. However, the communication path of the substrate portion 22*a* may be formed in a slit-shape, and it seems that the taper of the discharge port 22*d* extends downward by the communication path of the substrate portion 22*a*, also in the longitudinal direction of the slit (see, for example, FIG. 1D, FIG. 4B, FIG. 5B, FIG. 7C, FIG. 8 to FIG. 13). In this case, the length L1 of the slit portion 22*e* denotes a length of the communication path in the ejection direction, that is, the length from the delivery port 22*b* to the ejection port 22*d* in the ejection direction.

The length L1 of the slit portion 22*e* in the ejection direction (vertical direction) is preferably, for example, 2 to 30 mm, more preferably 3 to 25 mm. When the length L1 is shorter than 2 mm, there is a tendency that it becomes difficult to form foam along the shape of the slit portion 22*e*. When it exceeds 30 mm, there is a tendency that foam is continuously ejected from the ejection port 22*d* for a while even after stopping the ejection operation, making it difficult to separate from the nozzle 22*c*.

Further, the slit width (width in the lateral direction) W1 of the ejection port 22*d* is preferably 0.1 to 3 mm, more preferably 0.2 to 2 mm. When the slit width W1 is narrower than 0.1 mm, the strength of the molded foam is small, and there is a tendency that it is difficult to maintain the molded shape. While, when it is wider than 3 mm, there is a tendency that foam becomes difficult to be formed into a thin plate shape and therefore it is difficult to form foam having excellent design properties. Furthermore, the width W2 of the slit portion 22*e* in the longitudinal direction is preferably 2 to 30 mm, more preferably 3 to 25 mm. When the width W2 in the longitudinal direction is narrower than 2 mm, there is a tendency that the strength of the molded foam is small and therefore it is difficult to maintain the molded shape. While, when it is wider than 30 mm, there is a tendency that it is difficult to form foam having excellent design properties.

Further, the nozzles 22*c* having the aforementioned configuration are arranged in a spiral shape so as to spread counterclockwise from the center of the disc-shaped substrate portion 22*a*.

Figure 2:
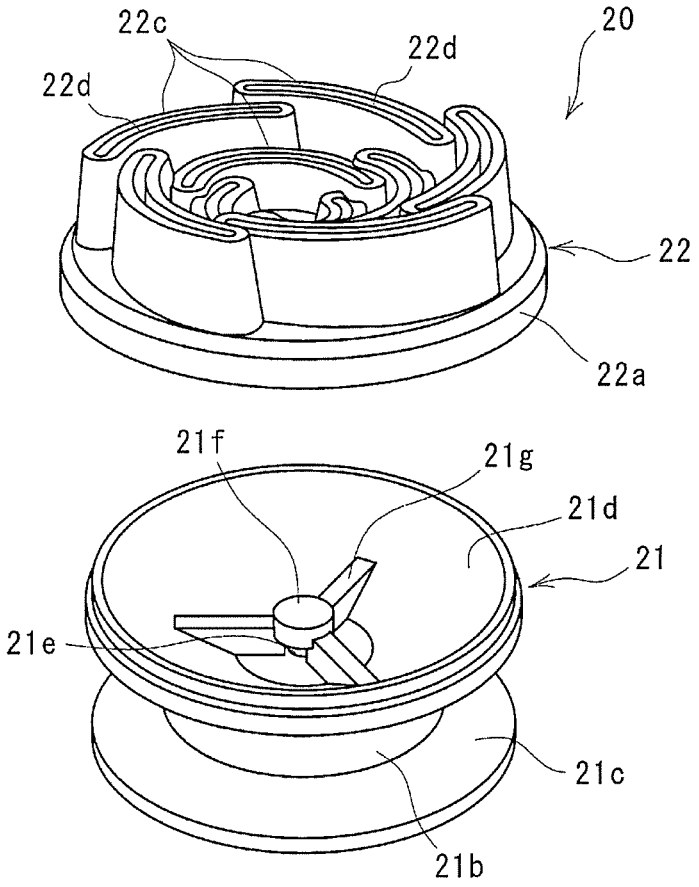
FIG. 2 is an exploded perspective view of the ejection member.

The heights of nozzles 22*c* are different as shown in FIG. 1B and FIG. 2. Specifically, the protruding height gradually decreases from the outer nozzle 22*c*1 to the intermediate nozzle 22*c*2 and then to the inner nozzle 22*c*3 toward the center of the substrate portion 22*a* (the center of the spiral). This state can be said that the height of the nozzle 22*c* changes in a stepwise manner (in a step-by-step manner) and the length L1 of the slit portion 22*e* decreases in a stepwise manner (in a step-by-step manner). Further, in each of the nozzles 22*c*, the tip end surface is inclined with respect to the ejection direction, and the portion positioned on the center side of the substrate portion 22*a* is lower in height than that positioned on the outer side. Furthermore, the width W2 of each nozzle in the longitudinal direction is narrowed toward the center from the outer nozzle 22*c*1 to the intermediate nozzle 22*c*2 and then to the inner nozzle 22*c*3 (see FIG. 1C).

When the ejection member 20 having the aforementioned configuration is attached to the stem 12*a* of the aerosol container 10 and the ejection member 20 is pressed downward (the stem 12*a* is operated), the content ejected from the stem 12*a* is first introduced into the expansion chamber E from the introduction port 21*e*. The content introduced into the expansion chamber E initially flows upward along the stem 12*a*, but collides with the baffle 21*f* to change the flow in the lateral direction. Further, vaporization of the liquefied gas in the content is accelerated by the impact due to the collision and the vaporized gas is released into the expansion chamber E, resulting in easy foaming in the expansion chamber E.

This content which flowed in the lateral direction and radially spread will foam sufficiently before reaching the delivery port 22*b* positioned at the upper portion of the expansion chamber E. For this reason, the content not foamed sufficiently will not be ejected to the outside from the nozzle 22*c* while maintaining the ejection momentum from the aerosol container 10. The fully foamed content flows into the nozzle 22*c* from the delivery port 22*b* and is ejected to the outside from the ejection port 22*d* of the nozzle 22*c*. At this time, since the slit portion 22*e* has a curved slit-shape and is formed in a tapered shape that narrows toward the ejection direction, the foamed content will advance through the slit portion 22*e* so as to be compressed gradually. Since the length L1 of the slit portion 22*e* in the ejection direction is made to be larger than the slit width W1 of the ejection port 22*d*, the foamed content is ejected from the ejection port 22*d* in a manner as to be extruded while being molded into a slit-shape, whereby the ejection direction (the axial direction of the nozzle 22*c*) is stabilized. As a result, adhesion between ejection materials (foam) ejected upward (in the axial direction) of the nozzle 22*c* is suppressed, which makes it possible to form the ejection material in a desired shape.

Figure 3:
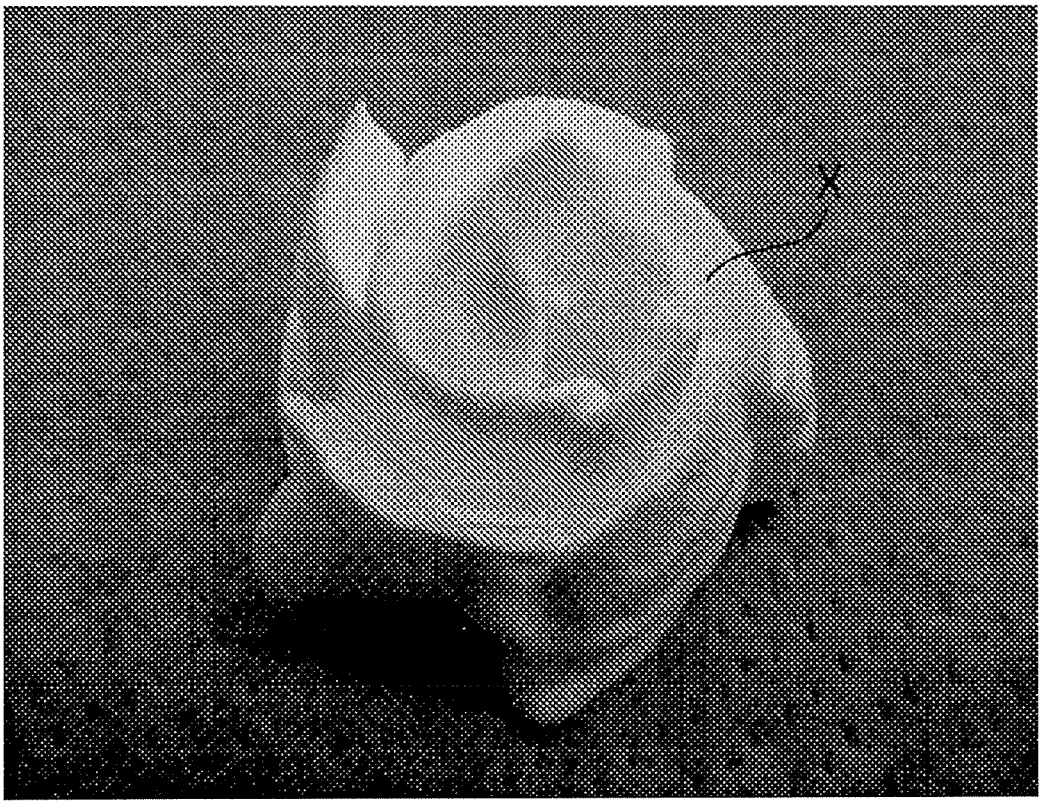
FIG. 3 is a photograph showing an ejection material.

A method of using the aerosol product is as follows. That is, the ejection port 22*d* of the nozzle is directed to an object such as a palm of a hand. In this state, the ejection operation is carried about 1 cm apart, and the nozzle 22*c* is slowly moved away from the object while ejecting the ejection material in a state in which the ejection material is adhered to the object. With this operation, the initially ejected foam adheres to the object, and the lastly ejected foam forms the top portion. For example, according to the ejection member 20 of this embodiment, as shown in FIG. 3, the curved plate-shaped foam ejected from respective nozzles 22*c* are concentrically arranged. Thus, an ejection material X having a rose flower-like shape can be obtained. It can be seen that the curved plate-shaped foam corresponding to petals are formed in an assuredly separated manner. Therefore, the surface area is larger as compared with a case in which an ejection material is ejected from a single nozzle 22*c*, and therefore the active ingredient can be easily volatilized.

Further, the heights of the nozzles 22*c* gradually decrease toward the center, and the tip end surface of each nozzle 22*c* is also inclined with respect to the ejection direction. For this reason, when foam is ejected to an object such as a palm, the difference between the area of the foam adhering to the object and the area of the foam adhering to the tip end surface of the nozzle becomes large, which facilitates separation of the foam from the nozzle and enhances the shape retainability of the foam molded by the nozzle without losing the shape.

The aerosol product of the present invention which forms an ejection material as described above is suitably used as, for example, a space product, such as, e.g., a fragrance, a deodorant, a fungicide, and a pest repellent, and a human body product, such as, a moisturizer, a cleanser such as a facial cleanser, and a bath additive.

Figure 4A:
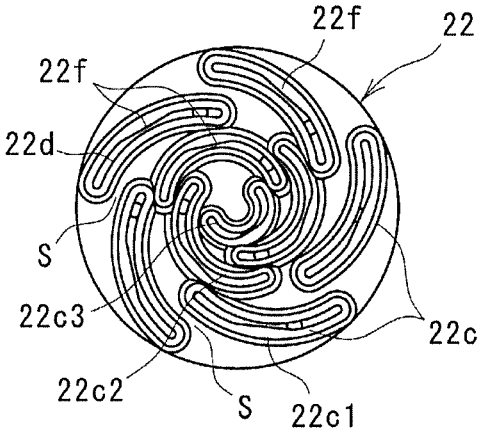
FIG. 4A and FIG. 4B are plan views of ejection members according to another respective embodiment.
Figure 4B:
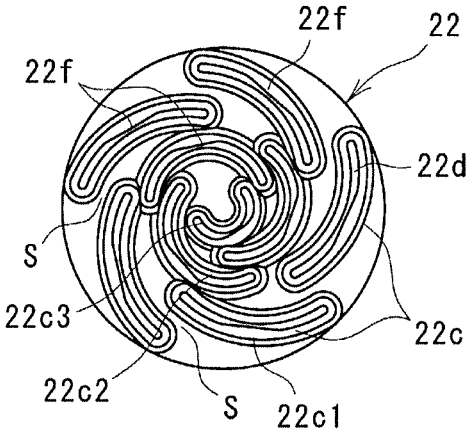

Further, as shown in FIG. 4, by making the slit width W1 of the ejection port 22*d* uneven, specifically, by making the slit width near the center portion narrower than the slit width near both ends by providing a throttle portion 22*f* near the center portion of the slit-like ejection port 22*d* in the longitudinal direction, the ejection speed and the ejection amount of the foaming content ejected from the nozzle 22*c* can be differentiated between the vicinity of the center portion of the ejection port 22*d* and both end portions thereof, which in turn can form foam different in height in the ejection direction. Specifically, since the ejection amount of the portion provided with the throttle portion 22*f* is smaller than that of the other portions, the height of the foam to be formed at the portion becomes lower than that to be foamed at the other portions. As a result, it is possible to form petals of more complicated shapes. Note that the throttle portion 22*f* is not limited to be provided in the vicinity of the center portion of the ejection port 22*d*, but may be provided in the vicinity of both end portions or at a plurality of portions. Also note that the throttle portion 22*f* may also be provided in the communication path.

By providing a gap S between nozzles 22*c* and 22*c* arranged adjacent in the radial direction, adhesion between the ejection materials can be further suppressed. Therefore, it is easy to form petals and the appearance becomes excellent. In addition, when water is applied to the aerosol product 1, the water sometimes enters between the nozzle 22*c* and the nozzle 22*c*. However, by providing the gap S so as to communicate with the outside, the gap S functions as a drainage path, which facilitates drainage of the water.

Figure 4C:
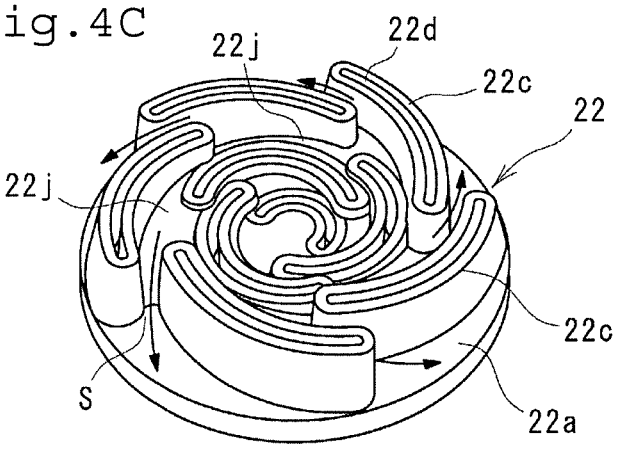
FIG. 4C is a perspective view of the ejection members according to those embodiments.

Further, in order to reduce the amount of water to be accumulated, the space between the nozzles 22*c* and 22*c* may be filled or the top surface of the substrate portion 22*a* may be lifted up to the vicinity of the tip end of the nozzle 22*c* to reduce the volume between the nozzles 22*c* and 22*c*. At this time, as shown in FIG. 4C, when an inclined surface (drainage slope) 22*j* that descends toward the gap S is provided between the nozzles 22*c* and 22*c*, the water between the nozzles 22*c* and 22*c* is naturally discharged (see the arrow in FIG. 4C). In FIG. 4, the gap S is provided between the outermost nozzles 22*c*1 and 22*c*1. However, such gap S may be provided between the outermost nozzle 22*c*1 and the intermediate nozzle 22*c*2 arranged inside thereof, between the intermediate nozzles 22*c*2 and 22*c*2, and/or between the intermediate nozzle 22*c*2 and the inner nozzle 22*c*3 arranged inside the intermediate nozzle. When a plurality of inner nozzles 22*c*3 is provided as shown in FIG. 9B, a gap S may be provided between the inner nozzles 22*c*3 and 22*c*3. In this case, water drainage can be further facilitated.

Figure 5A:
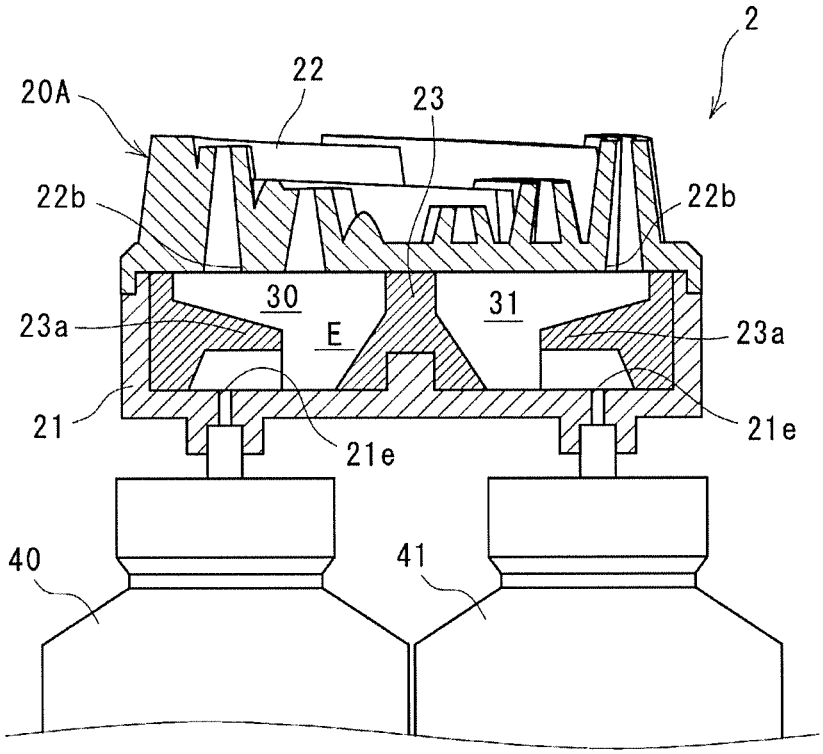
FIG. 5A is a cross-sectional view showing an aerosol product according to still another embodiment.
Figure 5B:
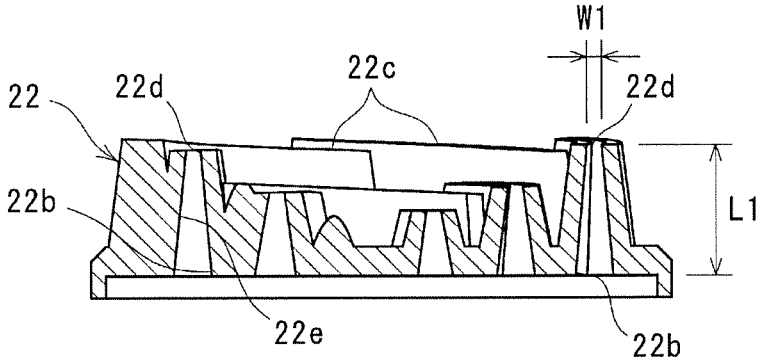
FIG. 5B is a cross-sectional view of a nozzle portion in which all communication paths are formed in a slit-shape.

FIG. 5 shows an aerosol product according to still another embodiment. This aerosol product 2 is characterized in that a partition member 23 partitioning the inside of the expansion chamber E is provided, the introduction port 21*e* and the delivery port 22*b* are provided in each of the spaces 30 and 31 divided into two by the partition member 23, and two aerosol containers 40 and 41 are provided and the separate aerosol containers 40 and 41 are communicated with the two respective introduction ports 21*e* and 21*e*.

In the aerosol product 2 having the aforementioned configuration, when the ejection member 20A is pushed downward, the contents are introduced from the respective aerosol containers 40 and 41 into the expansion chamber E. However, the expansion chamber E is partitioned by the partition member 23, and therefore the contents do not mix with each other. Accordingly, when the colors of contents are different from each other, it is possible to form ejection materials of different colors on the left and right, which further enhances the design properties. Note that in the drawing, the reference numeral "23*a*" denotes a protruding portion which functions as a baffle.

Figure 6:
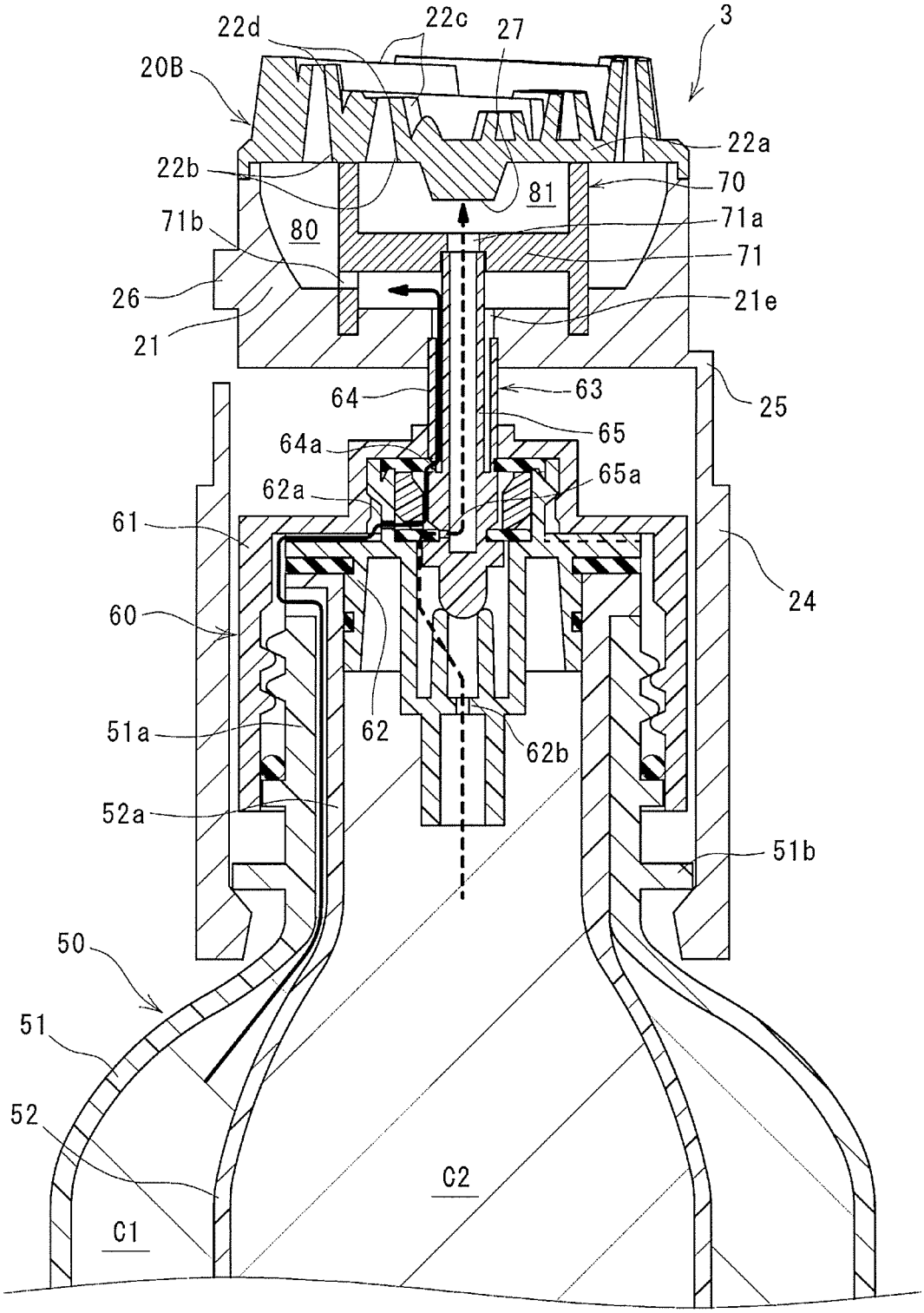
FIG. 6 is a cross-sectional view showing an aerosol product according to still yet another embodiment.

FIG. 6 shows an aerosol product according to still yet another embodiment. This aerosol product 3 is different from the above-described embodiments particularly in that the aerosol product uses a double aerosol container 50.

The double aerosol container 50 is configured to accommodate a flexible inner container 52 in an outer container 51 and fill a content C1 and a content C2 between the outer container 51 and the inner container 52 and in the inner container 52, respectively, to eject each content C1, C2 without mixing them. Thus, a two-liquid ejecting valve assembly 60 is provided. This two-liquid ejecting valve assembly 60 is configured as follows. That is, as indicated by the solid arrow in FIG. 6, the first content C1 filled between the outer container 51 and the inner container 52 is configured to be ejected from the upper end of the outer stem 64 via the gap between the neck portion 51*a* of the outer container 51 and the neck portion 52*a* of the inner container 52, the gap between a mountain cover 61 and a housing 62, a communication hole 62*a* through the housing side wall, and a stem hole 64*a* of the outer stem 64 of a double stem 63. Further, as indicated by the broken line arrow, the second content C2 filled in the inner container 52 is configured to be ejected from the upper end of the inner stem 65 via the communication hole 62*b* below the housing and a stem hole 65*a* of the inner stem 65.

This embodiment is also different from the above-described embodiments in that the partition member 70 is formed in a cylindrical shape. This partition member 70 is provided with a partition wall 71 which partitions the cylindrical inner space in the up and down spaces. Of the inner space, the lower space is communicated with the space on the outer peripheral side (the substrate portion 21 side) via an outlet hole 71*b* provided in the side surface of the partition member 70, and these two spaces form a first space 80. This first space 80 is communicated with the space between the outer container 51 and the inner container 52 when the outer stem 64 is connected to the introduction port 21*e* of the substrate portion 22*a*. Further, the upper side space of the inner space is a second space which communicates with the inner container 52 when the inner stem 65 is connected to an introduction port 71*a* of the partition wall 71.

The ejection member 20B of this embodiment is provided with a connection cylinder 24 on the lower side and is attached to the double aerosol container 50 by fitting the connection cylinder 24 to a flange portion 51*b* of the double aerosol container 50. The connection cylinder 24 and the base portion 21 are connected to each other at only one portion. When a finger hook 26 provided on the opposite side of the connecting portion 25 is pushed downward, the base portion 21 rotates with the connecting portion 25 functioning as a fulcrum to operate the double stem 63.

When the double stem 63 is operated, the first content C1 is introduced into the first space 80 via the outer stem 64. The introduced first content C1 changes its flow by the partition wall 71 functioning as a baffle, flows out of the outlet hole 71*b* to the outer periphery side, and is ejected to the outside from the ejection port 22*d* of the nozzle 22*c* via the delivery port 22*b*. On the other hand, the second content C2 is introduced into the second space 81 via the inner stem 65. The introduced second content C2 changes its flow by a protruding surface 27 which protrudes downward from the lower surface of the substrate portion 22*a* and functions as a baffle, and is sufficiently foamed. Then, the foamed second content is ejected to the outside from the ejection port 22*d* of the nozzle 22*c* via the delivery port 22*b*.

In the aerosol product 3 having the above-described configuration, the partition member 70 is formed in a cylindrical shape. Therefore, the first content C1 is ejected from the nozzles 22*c* provided outside the partition member 70 among the plurality of nozzles 22*c*, and the second content C2 is ejected from the nozzles 22*c* provided inside the partition member 70. Accordingly, when the first content C1 and the second content C2 are different in color, it is possible to form an ejection material different in color between the central portion and the outer peripheral portion, which further enhances the design properties.

FIG. 7 shows an ejection member according to still yet another embodiment. In this ejection member 20C, the nozzles 22*c* are curved in a side view as well as in a plan view. Specifically, the vicinity of the center of the nozzle 22*c* in the vertical direction (ejection direction) protrudes outward, and the tip end side of the nozzle 22*c* curves toward the inside (the approximate center of the substrate portion 22*a*), so that the side view shape of the nozzle 22*c* is formed in a substantially arcuate shape. Along the contour of the nozzle 22*c*, the communication path in the nozzle 22*c* is also curved. When the nozzle 22*c* (communication path) is curved as described above, the ejection material to be ejected from the ejection port 22*d* is ejected while curving so as to draw an arc. For this reason, by moving the nozzle 22*c* away from the object while ejecting the material in a state in which the ejection material is adhered to the object, the ejection material becomes likely to lean toward the outside (the direction away from the approximate center of the substrate portion 22*a*) which is the protruding direction, and as a whole the ejection material which looks as if a flower is opened can be obtained.

Figure 7A:
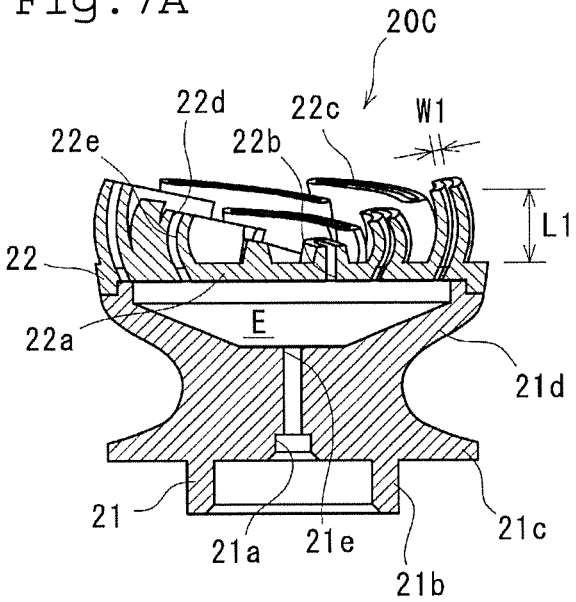
FIGS. 7A-7C show an ejection member according to still yet another embodiment.
Figure 7B:
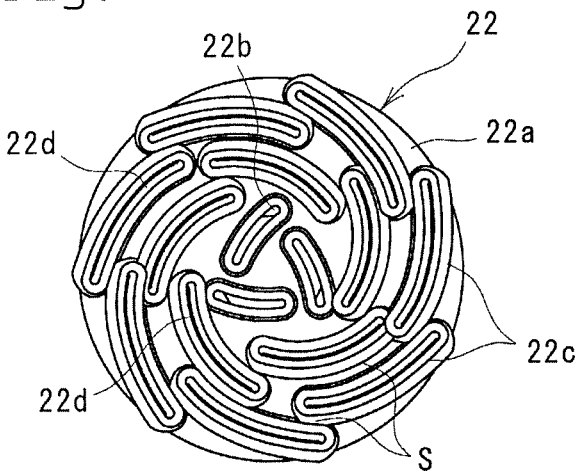
Figure 7C:
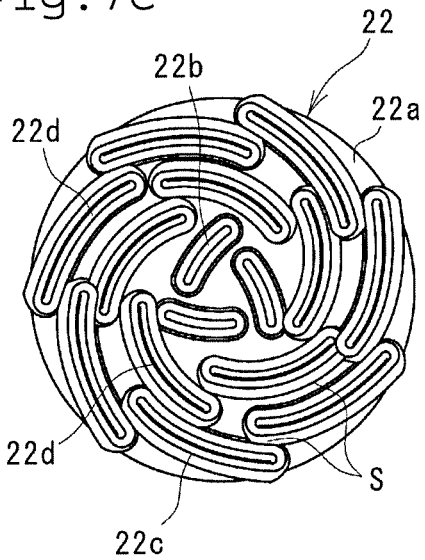

For the purpose of suppressing adhesion between ejection materials, as shown in FIG. 7B, a gap S is provided between the nozzles 22*c* and 22*c* arranged adjacent in the radial direction of the disc-shaped substrate portion 22*a*. As shown in FIG. 7A, the nozzle 22*c* near the center of the substrate portion 22*a* rises substantially vertically from the substrate portion 22*a*, and is configured to give a change of the degree of opening between the center side and the outer side of a flower-shaped ejection material. Further, in each of the individual nozzles 22*c*, the tip end surface is inclined with respect to the ejection direction, and the portion positioned on the center side of the substrate portion 22*a* is lower in height than that positioned on the outer side. For example, when the height difference is set to 1 to 3 mm, the separation of the foam from the nozzle 22*c* is improved.

Figure 8A:
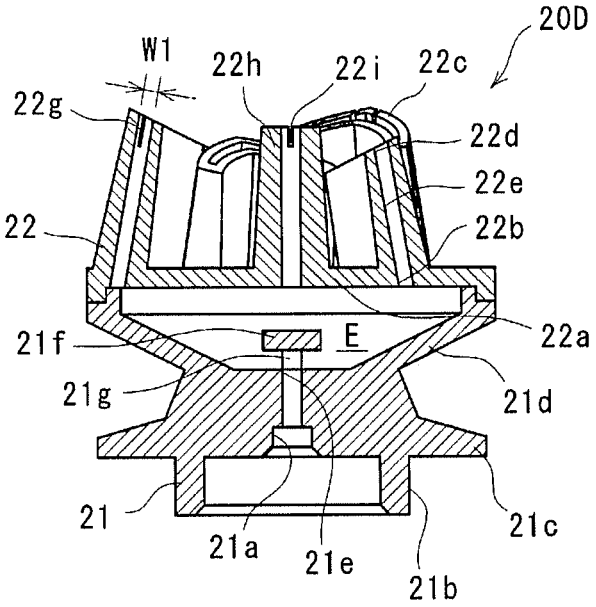
FIGS. 8A-8C show an ejection member according to still yet another embodiment.
Figure 8C:
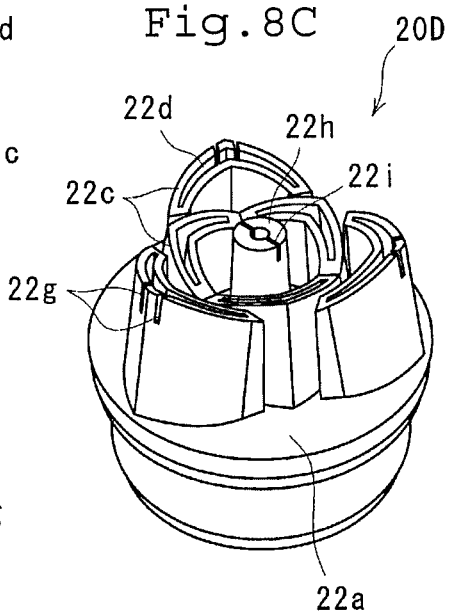
Figure 8B:
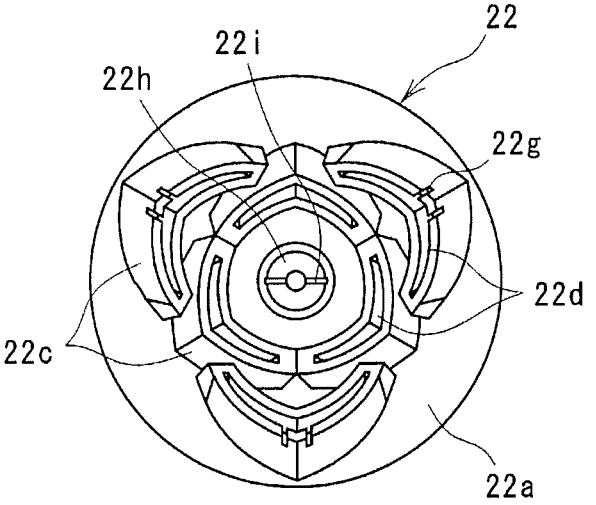

FIGS. 8A-8C show ejection members according to still yet another embodiment. The above-described ejection members 20, 20A to 20C each are mainly intended to obtain an ejection material imitating a rose flower, but this ejection member 20D is intended to obtain an ejection material imitating a lily flower.

As shown in FIG. 8B, the nozzle 22*c* is provided with a bent portion at the center thereof in a plan view and a substantially V-shaped portion in which the portions extending from the bent portion toward both sides are curved. A total of six nozzles are arranged on the substrate portion 22*a* so as to protrude outward. Specifically, three of nozzles are arranged on the outer peripheral side of the substrate portion 22*a* at equidistantly intervals with a space therebetween. Three of nozzles are positioned inside of the outer nozzles 22*c* and 22*c* so as to be positioned between the outer nozzles 22*c* and 22*c* so that the left and right end portions are in contact with each other. The inner nozzles, the outer nozzles, the inner nozzle and the outer nozzle are respectively separated from each other at least in the vicinity of the lower end and a gap is formed therebetween. For this reason, those gaps can be used as drainage paths.

Each of the nozzles 22*c* is inclined inward. Along the contour of the nozzle 22*c*, the communication path in the nozzle 22*c* is also inclined inward. The slit width W1 of the ejection port (communication path) 22*d* is the widest at the center portion in a plan view, and gradually narrows toward the end portions. The tip end surface of the nozzle 22*c* is inclined so that the center is highest and the height decreases toward the end portions. The outer nozzle 22*c* is provided with cuts 22*g* for communicating the communication path with the outside at the tip end of the outer peripheral wall along the ejection direction. At the center of the substrate portion 22*a*, a cylindrical nozzle 22*h* for forming an imitation "pistil" is separately provided. This nozzle 22*h* is also provided with a cut 22*i* at the tip end thereof.

In the ejection member 20D configured as described above, since the nozzle 22*c* is inclined inward, by moving the nozzle 22*c* away from the object while ejecting the ejection material in a state in which the ejection material is adhered to the object, the ejection material ejected from the nozzle 22*c* spreads outward. As a result, a state as if a flower is opened can be obtained. Further, the slit width W1 at the center of the ejection port 22*d* (and the communication path) is wider than that at the end portions, and the tip end surface of the nozzle 22*c* is inclined so that the center becomes the highest (i.e., the center is sharp). Therefore, by moving the ejection member away from the object in a state in which the ejection material is adhered to the object, the foam at the center portion follows the nozzle 22*c* longer than the foam at the end portions (i.e., the foam at the central portion is pulled up). As a result, an ejection material with a pointed central portion can be obtained. Therefore, with the ejection member 20D, an ejection material formed in a shape imitating a lily flower as a whole can be obtained. Further, since the cuts 22*g* are provided at the tip end of the nozzle 22*c*, streaks (ridge lines) protruding outward along the cuts 22*g* are formed on the ejection material. Besides the function of improving the appearance, the streaks also exert the function of increasing the stiffness of the foam in the vertical direction.

The portion having substantially the same configuration as the ejection member 20 is allotted by the same reference numeral, and the detailed description thereof will be omitted.

Figure 9A:
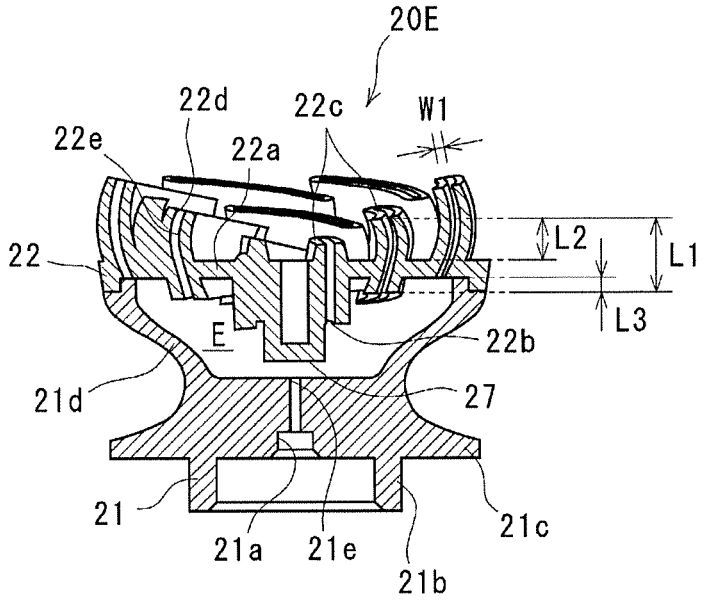
FIGS. 9A-9B show an ejection member according to still yet another embodiment.
Figure 9B:
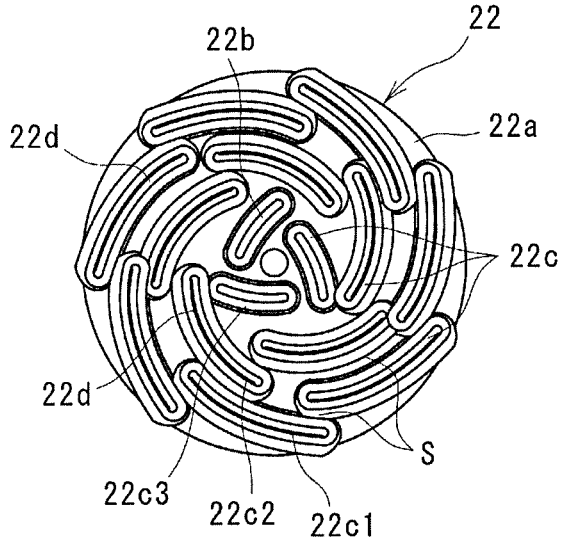

FIGS. 9A and 9B show an ejection member according to still yet another embodiment. This ejection member 20E is characterized in that the nozzle 22*c* protrudes toward the expansion chamber E side. Specifically, as shown in FIG. 9A, although the nozzles 22*c* decrease in height sequentially toward the center of the substrate portion 22*a*, in the center (inner) side intermediate nozzle 22*c*2 and the inner nozzle 22*c*3 in which the protruding length L2 from the upper surface of the substrate portion 22*a* is shorter as compared with the outer nozzle 22*c*1 on the outer side, the lower end side of the nozzle 22*c* protrudes from the lower surface of the substrate portion 22*a* to the expansion chamber E side. This state can be said that the intermediate nozzle 22*c*2 and the inner nozzle 22*c*3 are extended downward (toward the base portion 21 side).

By making the nozzle 22*c* long in the vertical direction by projecting the nozzle 22*c* toward the expansion chamber E side as described above, the length L1 of the slit portion 22*e* in the ejection direction becomes long. Therefore, additional foaming of the ejection material can be suppressed. For this reason, it becomes easy to control the shape (thickness) of the ejection material, which in turn can suppress collapse of the foam near the center of the substrate portion 22*a* and adhesion between the foam. Thus, it is possible to obtain a more well-formed foam. Further, the protruding length L2 of the nozzle 22*c* from the upper surface of the substrate portion 22*a* is not changed. Therefore, the configuration in which the heights of the nozzles 22*c* gradually decrease toward the center is maintained, which can still exert the effects that foam detachment (foam separation) from the tip end of the nozzle 22*c* is good and foam is formed in a three-dimensional shape.

In order to uniform the state of foam to be ejected from each nozzle 22*c*, it is preferable to adjust the protruding length L3 of the nozzle 22*c* toward the expansion chamber E side so that the length L1 of the slit portion 22*e* is equalized. However, when the length L1 of the slit portion 22*e* in the ejection direction is short, there is a tendency that thick foam is obtained, and when the length L1 is long, there is a tendency that thin foam is obtained. Therefore, the length L3 may be appropriately changed according to a desired shape. For example, in order to change the thickness of foam with one nozzle 22*c*, the protruding length L3 from the lower surface is shortened according to the protruding length L2 from the upper surface which becomes shorter as it advances toward the center of the substrate portion 22*a*. In cases where it is not desired to change the thickness, the protruding length L3 from the lower surface may be made longer so as to compensate for the decrease of the protruding length L2 from the upper surface.

Further, in this embodiment, since the nozzle 22*c* is extended to the expansion chamber E side, the delivery port 22*b* is close to the introduction port 21*e* as compared with the other embodiments. Therefore, a protruding surface 27 is provided so as to be positioned closer to the introduction port 21*e* than the delivery port 22*b* which is nearest to the introduction port 21*e* to thereby function as a baffle. Since the other configuration is substantially the same as that of the ejection member 20C shown in FIG. 7, the same reference numerals are allotted and the detailed description thereof will be omitted.

Figure 10A:
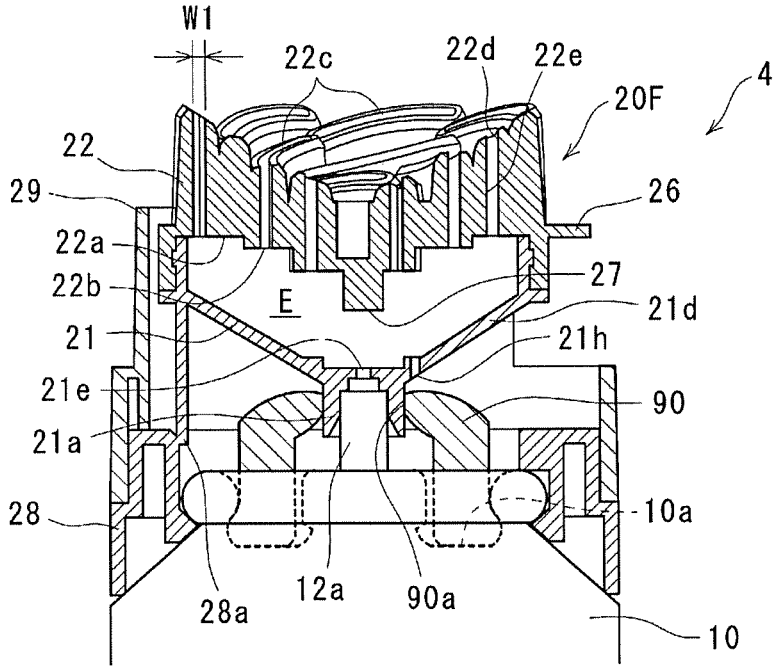
FIGS. 10A-10B are aerosol products according to still yet another embodiment.

FIG. 10 shows an ejection member according to still yet another embodiment. This ejection member 20F is characterized in that a drainage mechanism is provided in the expansion chamber E. Specifically, a drain hole 21*h* is provided in the base portion 21. Thus, when the drain hole 21*h* is provided in the base portion 21, even if water enters the expansion chamber E when rinsing the nozzle portion 22 or the like, the water can be easily drained. The drain hole 21*h* is preferably provided as low as possible in a state in which the aerosol product 4 is in an upright state. In FIG. 10, the drain hole 21*h* is provided in the vicinity of the bottom of the cup-shaped body 21*d* of the base portion 21 in which the upper surface (the expansion chamber E side surface) is formed in a mortar shape (conical shape). With this, natural drainage can be performed by simply placing the aerosol product 4.

However, if the drain hole 21*h* is open when in use (at the time of ejecting the content), the content in the expansion chamber E leaks out from the drain hole 21*h*. Under the circumstances, the drainage mechanism of this ejection member 20F is provided with a closing member 90 which closes the drain hole 21*h* when in use and opens the drain hole 21*h* when not in use, that is, when the nozzle portion 22 and the base portion 21 are not depressed (not be inclined). As shown in FIG. 10, the closing member 90 is provided below the base portion 21 so as to face the drain hole 21*h*. The shape is formed in a substantially cylindrical shape, and the lower part thereof is inserted into an annular groove 10*a* provided in the upper surface (mounting cup) of the aerosol container 10. The upper portion is formed in a substantially dome-shape, and is provided in the center thereof with an insertion hole 90*a* for inserting the connecting portion (stem mounting portion) 21*a* of the base portion 21. As the material, a resin having flexibility, such as, e.g., urethane foam, or rubber, etc., may be used.

When not in use, the closing member 90 does not come into contact with the lower surface of the base portion 21 and is in a state in which there is a gap between the closing member 90 and the drain hole 21*h*, which does not prevent draining from the drain hole 21*h*. Water flows down toward the closing member 90 arranged below, but the inner peripheral surface of the insertion hole 90*a* of the closing member 90 is in contact with the outer peripheral surface of the connecting portion 21*a* of the base portion 21, and therefore it does not flow into the stem 12*a* side.

Figure 10B:
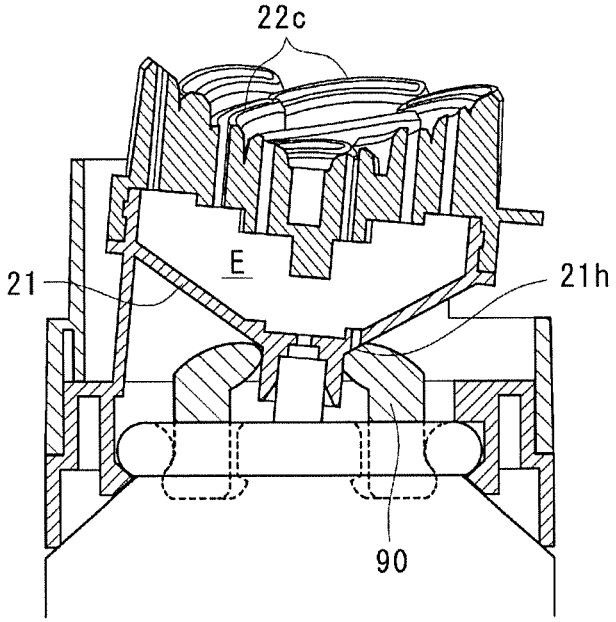

When in use, the closing member 90 comes into contact with the lower surface of the approaching (inclining) base portion 21 to close the drain hole 21*h*. Therefore, the content in the expansion chamber E will not leak from the drain hole 21*h*. Note that FIG. 10B is depicted in an upright state for convenience sake, but this aerosol product 4 is basically used in an inverted state in the same manner as the above-described other aerosol products.

By the way, in this ejection member 20F, the upper surface (the expansion chamber E side surface) of the cup-shaped body 21*d* of the base portion 21 is formed in a mortar shape. With this, the content collided with the protruding surface 27 and extended in the lateral direction flows smoothly to the outer nozzles 22*c*. Therefore, the content can be ejected uniformly from all of the plurality of nozzles 22*c* provided from the center of the substrate portion 22*a* toward the outside. Further, the fact that the lower ends of the nozzles 22*c* protruding into the expansion chamber E are connected with each other and no recess is formed on the lower surface of the nozzle portion 22 also helps smooth flow of the content. For example, when the lower surface of the nozzle portion 22 is formed in a conical shape, the content flow becomes smoother.

Further, the ejection member 20F is provided with an annular shoulder cover 28 to be fitted to the upper end of the aerosol container 10, and the base portion 21 is connected to the shoulder cover 28 via the hinge 28*a*. Therefore, as shown in FIG. 10B, the nozzle 22*c* operates so as to be tilted when in use. However, the base portion 21 is not always required to be connected in a rotatable manner with the hinge 28*a*, and may be simply mounted on the stem 12*a* in the same manner as in the above-described other ejection members. Note that the reference numeral "29" denotes a decorative cover that covers the periphery of the closing member 90 and the base portion 21.

The tip end surface of the nozzle 22*c* is inclined so as to descend toward the center of the substrate portion 22*a*. For this reason, the detachment of the foam from the nozzle 22*c* is excellent. Further, the slit portion 22*e* of the nozzle 22*c* has approximately the same width (the short direction W1 and the longitudinal direction W2) from the delivery port 22*b* to the ejection port 22*d*. The portion having substantially the same configuration as the other ejection members is allotted by the same reference numeral, and the detailed description thereof will be omitted.

Figure 11A:
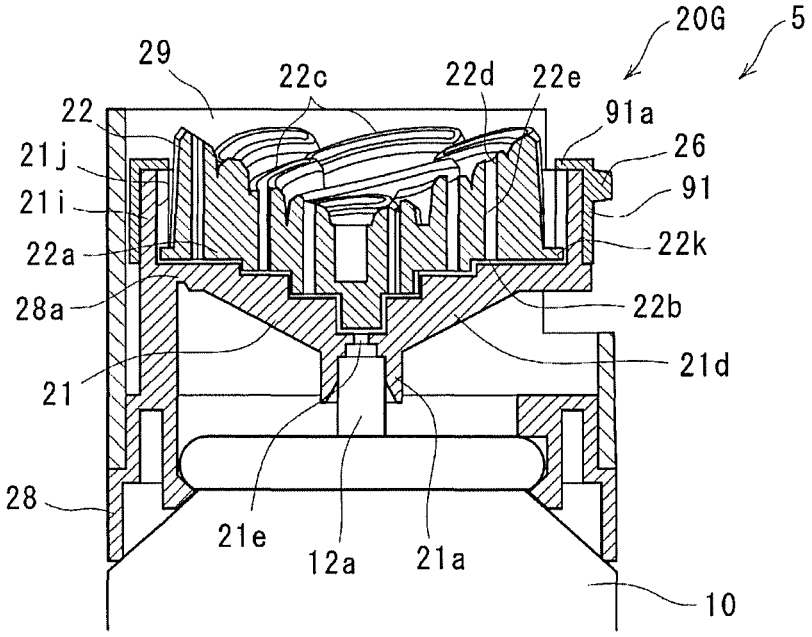
FIGS. 11A and 11B are aerosol products according to still yet another embodiment.
Figure 11B:
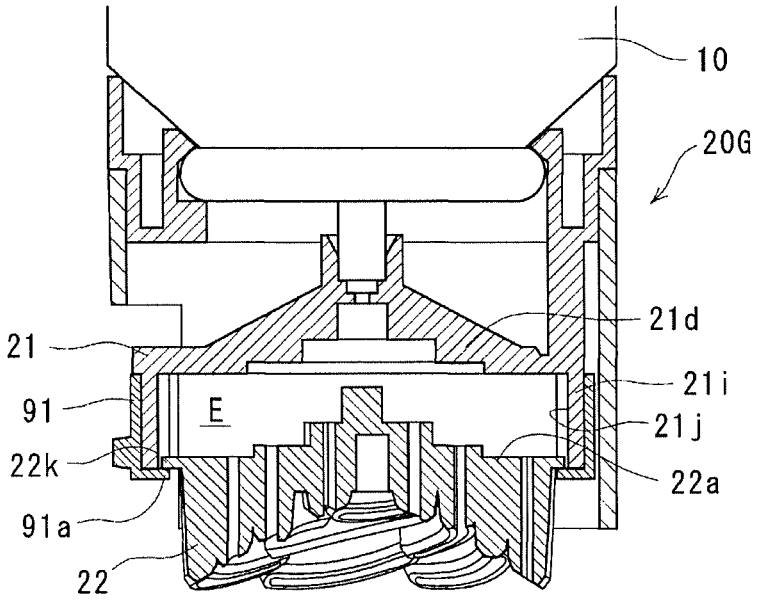

FIG. 11 shows an ejection member according to still yet another embodiment. This ejection member 20G is characterized in that an expansion chamber E is formed only when it is in an inverted state (when in use). Specifically, the nozzle portion 22 is slidable in the base portion 21 in the vertical direction. More specifically, the nozzle portion 22 is not fixed to the base portion 21, and the outer periphery of the nozzle portion 22 is surrounded by a rising wall 21*i* rising upward from the outer edge of the cup-shaped body 21*d* of the base portion 21, and is movable vertically along the inner surface of the rising wall 21*i*. Accordingly, in a state in which the aerosol product 5 is in an upright state, the nozzle portion 22 descends downward (slides toward the base portion 2) and comes into contact with the base portion 21. The upper surface of the cup-shaped body 21*d* is formed to have substantially the same shape (substantially uneven shape) as the shape of the lower surface of the nozzle portion 22, no expansion chamber E is formed between the base portion 21 and the nozzle portion 22.

When in use, inverting the aerosol product 5 (pointing down the nozzle 22*c*) causes the nozzle portion 22 to descend downward by its own weight (sliding away from the base portion 21), so that an expansion chamber E is formed. The nozzle portion 22 is provided with an engaging protrusion 22*k* formed so as to extend the substrate portion 22*a* radially outward and a cover portion material 91 provided with an engaging piece 91*a* to be engaged with the engaging protrusion 22*k* is attached to the rising wall 21*i*, so that the nozzle portion 22 never falls off. Further, on the inner surface of the rising wall 21*i*, a longitudinal groove 21*j* is provided along the engaging protrusion 22*k* to allow only the sliding movement of the nozzle portion 22 and restrain the rotation.

In the ejection member 20G having the above-described configuration, in the upright state, that is, in the unused state, the expansion chamber E is not formed. For this reason, there is no concern that water will accumulate in the expansion chamber E even when water is applied. Further, by sliding the nozzle portion 22 toward the base portion 21 side after the use, the content remained in the expansion chamber E can be discharged, so cleaning can be performed easily. When forming the expansion chamber E, the ejection pressure of the content may be used other than the own weight of the nozzle portion 22. The portion having substantially the same configuration as the other ejection members is allotted by the same reference numeral, and the detailed description thereof will be omitted.

Figure 12:
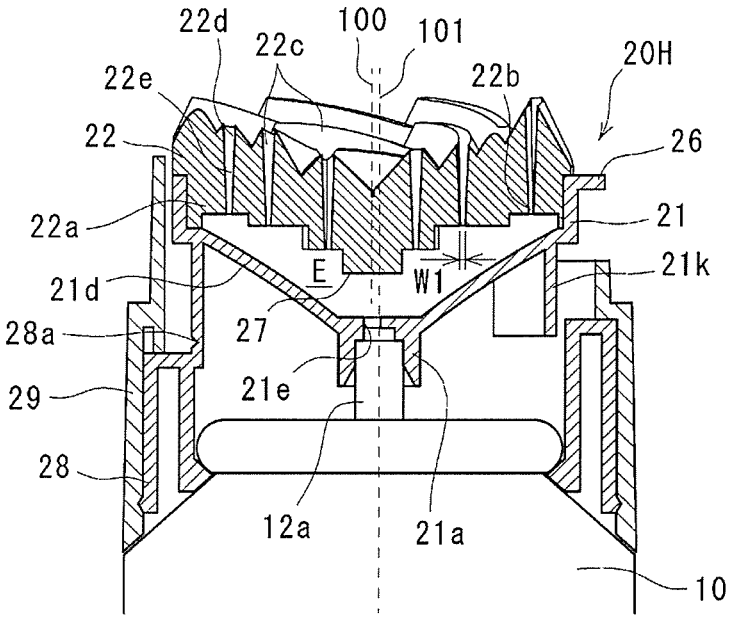
FIG. 12 shows a cross-sectional view of an ejection member according to still yet another embodiment.

FIG. 12 shows an ejection member 20H according to still yet another embodiment. In this ejection member 20H, the slit portion 22*e* of the nozzle 22*c* is formed in a tapered shape that expands from the delivery port 22*b* to the ejection port 22*d* toward the ejection direction. For this reason, the flow path resistance in the slit portion 22*e* can be suppressed, which makes it easy to eject the content in the expansion chamber E to the outside. As to the shape of the slit portion 22*e*, an area from the delivery port 22*b* to the middle of the slit portion may be formed in a tapered state that narrows, and an area from the middle to the ejection port 22*d* may be formed in a tapered state that expands. Further, the shape may be formed in a shape that has approximately the same width from the delivery port 22*b* to the middle of the slit portion and then expands from the middle to the ejection port 22*d* in the tapered state. Also in this embodiment, since the length L1 of the slit portion 22*e* in the ejection direction is larger than the slit width W1 of the ejection port 22*d*, in the same manner as in the other ejection members, the shape of the foam is less likely to collapse and foam molded in a desired shape can be obtained. Regarding the width W2 of the slit portion 22*e* in the longitudinal direction too, it may be formed in a tapered shape that expands from the delivery port 22*b* to the ejection port 22*d* toward the ejection direction, it may be formed in a tapered shape that narrows from the delivery port 22*b* to the ejection port 22*d* toward the ejection direction, or it may be formed in a tapered shape that changes in taper angle in the middle or changes in the middle so as to have approximately the same width.

Further, in this ejection member 20H, the central axis 100 (the central axis of the spirally aligned nozzles 22*c*) of the substrate portion 22*a* that is a foundation of the plurality of nozzles 22*c* is offset from the central axis 101 of the connecting portion 21*a* to be connected to the stem 12*a* of the aerosol container 10. Describing specifically, the base portion 21 is supported by the shoulder cover 28 via the hinge 28*a*, and the central axis 100 of the substrate portion 22*a* is shifted toward the hinge 28*a* side with respect to the central axis 101 of the connecting portion 21*a*. Note that the central axis 101 of the connecting portion 21*a* is also the central axis of the aerosol container 10, the stem 12*a*, the shoulder cover 28, and the decorative cover 29. In this way, when the central axis 100 of the substrate portion 22*a* is shifted toward the hinge 28*a* side, it is possible to position the finger hook 26 toward the inside of the shoulder cover 28, the decorative cover 29, and the aerosol container 10 in a plan view while sufficiently securing the protruding length of the finger hook 26 extending in the horizontal direction from the opposite side of the hinge 28*a*. Therefore, it is not necessary to reduce the diameter of the nozzle portion 22 in order to secure the protruding length of the finger hook 26, and large foam can be obtained.

When using the aerosol product, the aerosol container 10 is usually held by a thumb, a middle finger, a ring finger, and a little finger with an index finger hooked on finger hook 26 so as to grab the aerosol container 10. At this time, since the finger hook 26 is located at a position inner than the aerosol container 10 in a plan view, the index finger does not warp, resulting in an easy operation. As for the introduction port 21*e*, it is shifted according to the central axis 100 of the nozzle portion 22. However, it is not always required to be shifted. In the drawing, the reference numeral "21*k*" positioned below the finger hook 26 denotes a shielding plate for concealing the inside of the shoulder cover 28 and for preventing the entry of water.

Further, in the same manner as in the ejection members shown in FIG. 9, FIG. 10, and FIG. 11, the ejection member 20H is provided so that the protruding surface 27 functioning as a baffle is closer to the introduction port 21*e* than the delivery port 22*b*. Therefore, it is possible to suppress the content not sufficiently foamed from being ejected from the nozzle 22*c*. Further, in this ejection member 20H, since the upper surface of the cup-shaped body 21*d* of the base portion 21 is also formed in a mortar shape, the content can be smoothly introduced to the outer nozzle 22*c*. The feature that the lower ends of the nozzles 22*c* protruding into the expansion chamber E are connected with each other is the same as that of the ejection members shown in FIG. 10 and FIG. 11.

Further, in the ejection member 20H, the outer surface of the nozzle 22*c* is formed in a tapered shape that becomes thinner toward the tip end (ejection direction). This tapered surface continues to the tip end of the nozzle 22*c* (ejection port 22*d*), in other words, it continues until it contacts the inner surface of the nozzle constituting the slit portion 22*e*. Therefore, the wall thickness at the tip end of the nozzle is very thin, in other words, it is in a pointed shape, so the foam adhesion area is small. As a result, the detachment of foam from the nozzle 22*c* is good. The portion having substantially the same configuration as the other ejection members is allotted by the same reference numeral, and the detailed description thereof will be omitted.

Figure 13:
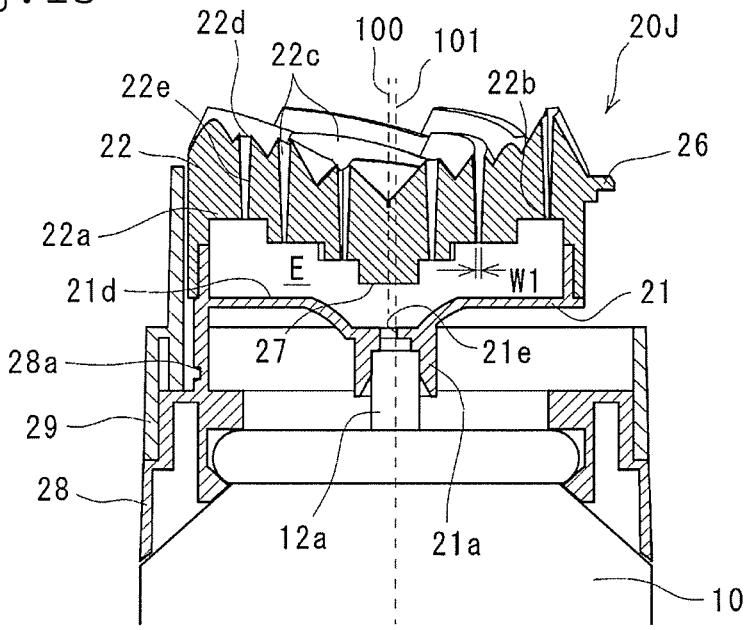
FIG. 13 shows a cross-sectional view of an ejection member according to still yet another embodiment.

FIG. 13 shows an ejection member 20J according to still yet another embodiment. In this ejection member 20J, the upper surface (inner surface) of the cup-shaped body 21*d* is formed in a cup-shape (cylindrical shape), and the shape of the expansion chamber E is formed in a cup-shape (cylindrical shape). As described above, by forming the portion (cup-shaped body 21*d*) constituting the bottom surface and the side surface of the expansion chamber E into a cup shape, it is possible to increase the volume of the expansion chamber E as compared with the case in which this portion is formed in a mortar shape. For this reason, it is possible to sufficiently foam the content in the expansion chamber E, which can suppress ejection of the content not sufficiently foamed to the outside. As a result, the shape of the foam ejected to the outside while being molded by the slit portion 22*e* becomes less likely to collapse. The other configurations are substantially the same as those of the ejection member 20H shown in FIG. 12.

Although representative embodiments of the present invention are described above, the present invention is not limited to the aforementioned embodiments, and it is possible to carry out while making various modifications within the scope of the present invention. For example, in cases where the introduction port 21*e* and the delivery port 22*b* of the expansion chamber E are sufficiently far away from each other, or in cases where there is no delivery port 22*b* on the extended line of the stem 12*a*, it is not always necessary to provide a baffle. Further, the structures disclosed in the aforementioned embodiments may be combined as appropriate. That is, the feature that the length L1 of the slit portion in the ejection direction is larger than the slit width W1 of the ejection port is common to all ejection members, but configurations that are not common may be combined as appropriate. For example, the slit width W1 of the communication path of each of the ejection members 20C, 20D, 20E, 20F, and 20G shown in FIG. 7 to FIG. 11 is constant in the ejection direction. However, it may be formed in a tapered shape in the same manner as in the ejection member 20 shown in FIG. 1 or the ejection member 20H shown in FIG. 12. Further, a baffle may be provided to the ejection member 20C. The inclined surface 22*j* and the drainage mechanism of the expansion chamber E can also be applied to each ejection member. Note that instead of the closing member 90, the drain hole 21*h* may be plugged with a finger. The configuration in which a drainage slope is provided between the nozzles 22*c* and 22*c* can also be applied to each ejection member. The configuration in which the portion (the cup-shaped body 21*d*) constituting the bottom surface and the side surface of the expansion chamber E is formed in a cup-shape can also be applied to each ejection member. Further, it may be configured such that the base portion 21 is used as a common member and the nozzle portion 22 is exchangeable. For example, any one of the nozzle portions shown in FIG. 7 to FIG. 13 may be replaceably attached to the base portion shown in FIG. 1.

DESCRIPTION OF REFERENCE SYMBOLS

1, 2, 3, 4, 5: aerosol product
10: aerosol container
11: container
12: valve assembly
12*a*: stem
20, 20A, 20B, 20C, 20D, 20E, 20F, 20G, 20H, 20J: ejection member
21: base portion
21*a*: connecting portion
21*b*: cover portion
21*c*: flange portion (finger hook)
21*d*: cup-shaped body
21*e*: introduction port
21*f*: baffle
21*g*: rib
21*h*: drain hole
21*i*: rising wall
21*j*: longitudinal groove
21*k*: shielding plate
22: nozzle portion
22*a*: substrate portion
22*b*: delivery port
22*c*: nozzle
22*d*: ejection port
22*e*: slit portion
22*f*: throttle portion
22*g*: cut
22*h*: nozzle
22*i*: cut
22*j*: inclined surface
22*k*: engaging protrusion
23: partition member
23*a*: protruding portion
24: connection cylinder
25: connecting portion
26: finger hook
27: protruding surface
28: shoulder cover
28*a*: hinge (fulcrum)
29: decorative cover
30, 31: partitioned space
40, 41: two aerosol containers
50: double aerosol container
51: outer container
51*a*: neck portion
51*b*: flange portion
52: inner container
52*a*: neck portion
60: two-liquid ejecting valve assembly
61: mountain cover
62: housing
62*a*: communication hole in the housing side wall
62*b*: communication hole in the housing lower portion
63: double stem
64: outer stem
64*a*: stem hole
65: inner stem
65*a*: stem hole
70: partition member
71: partition wall
71*a*: introduction port of the partition wall
71*b*: outlet hole
80: first space
81: second space
90: closing member
90*a*: insertion hole
91: cover member
91*a*: engaging piece
92: lever
100: central axis of the nozzle portion
101: central axis of the connecting portion
$A_{max}$: maximum cross-sectional area of the expansion chamber
V: volume of the expansion chamber
C1: first content
C2: second content
E: expansion chamber
S: gap between nozzles
L1: length of the slit portion in the ejection direction
L2: protruding length (height) of the nozzle from the upper surface of the substrate portion
L3: protruding length of the nozzle from the lower surface of the substrate portion
W1: slit width of the ejection port (width of the nozzle in the thickness direction)
W2: width of the ejection port in the longitudinal direction
X: ejection material

The invention claimed is:

1. An ejection member to be connected to an aerosol container filled with a foaming content, the ejection member comprising:

a body comprising a base portion and a nozzle portion, wherein the base portion and the nozzle portion form an expansion chamber, wherein the expansion chamber encourages foaming of the foaming content from the aerosol container, wherein the base portion comprises a first introduction port that introduces the foaming content from the aerosol container into the expansion chamber, wherein the nozzle portion comprises 1) an inner surface that faces the expansion chamber and 2) an outer surface that faces the outside, wherein the nozzle portion comprises a first nozzle and a second nozzle that extend from the inner surface to the outer surface, wherein the first nozzle and the second nozzle are configured to eject the foaming content introduced into the expansion chamber to outside, wherein each of the first nozzle and the second nozzle comprises 1) a delivery port, 2) an ejection port, and 3)

a communication path that extends between the delivery port and the ejection port, wherein the delivery port is disposed on the inner surface of the nozzle portion and the ejection port is disposed on the outer surface of the nozzle portion such that the foaming content introduced into the expansion chamber is ejected outside through the delivery port, the communication path, and the ejection port, and wherein a tip end surface of each of the first nozzle and the second nozzle is inclined with respect to an ejection direction of the foaming content.

2. The ejection member as recited in claim 1, wherein the inner surface of the nozzle portion comprises a protruding section and a non-protruding section, wherein the first nozzle extends from the protruding section of the inner surface to the outer surface, and wherein the second nozzle extends from the non-protruding section of the inner surface to the outer surface.

3. The ejection member as recited in claim 2, wherein the first nozzle and the second nozzle protrude from the outer surface of the nozzle portion, wherein a protruding portion of the first nozzle protruding from the outer surface of the nozzle portion has a first height, wherein a protruding portion of the second nozzle protruding from the outer surface of the nozzle portion has a second height, and wherein the first height of the first nozzle is lower is second height of the second nozzle.

4. The ejection member as recited in claim 1, wherein the first nozzle and the second nozzle protrude from the outer surface of the nozzle portion, and wherein an outer surface of a protruding portion of the first nozzle protruding from the outer surface of the nozzle portion and an outer surface of a protruding portion of the second nozzle protruding from the outer surface of the nozzle portion each has a tapered shape that narrows toward the nozzle portion.

5. The ejection member as recited in claim 1, wherein the first nozzle and the second nozzle protrude from the outer surface of the nozzle portion, and wherein a first height of a protruding portion of the first nozzle protruding from the outer surface of the nozzle portion differs from a second height of a protruding portion of the second nozzle protruding from the outer surface of the nozzle portion.

6. The ejection member as recited in claim 5, wherein the first height of the first nozzle differs from the second height of the second nozzle such that one of the first height and the second height disposed closer to a center of the nozzle portion than another one of the first height and the second height is shorter than the another one of the first height and the second height.

7. The ejection member as recited in claim 1, wherein the ejection port has a slit-shape that curves in a direction orthogonal to the ejection direction of the foaming content.

8. The ejection member as recited in claim 1, wherein the first nozzle and the second nozzle are spirally arranged.

9. The ejection member as recited in claim 1, wherein the first nozzle and the second nozzle are arranged radially adjacent to each other, and wherein a gap is provided between radially adjacent the first nozzle and the second nozzle.

10. The ejection member as recited in claim 1, wherein the expansion chamber is partitioned into a first partitioned space and a second partitioned space, wherein the base portion comprises a second introduction port, wherein the first partitioned space is provided with the first introduction port and the delivery port of the first nozzle, and wherein the second partitioned space is provided with the second introduction port and the delivery port of the second nozzle.

11. The ejection member as recited in claim 1, wherein a central axis of the nozzle portion is shifted from a central axis of a connecting portion of the base portion to connect the body to a stem of the aerosol container.

12. An aerosol product comprising:

the aerosol container filled with the foaming content; and the ejection member as recited in claim 1 attached to the aerosol container.

13. The ejection member as recited in claim 1, wherein an area around the introduction port is mortar shaped.

14. An ejection member to be connected to an aerosol container filled with a foaming content, the ejection member comprising:

a body comprising a base portion and an nozzle portion, wherein the base portion and the nozzle portion form an expansion chamber, wherein the expansion chamber encourages foaming of the foaming content from the aerosol container, wherein the base portion comprises a first introduction port that introduces the foaming content from the aerosol container into the expansion chamber, wherein the nozzle portion comprises 1) an inner surface that faces the expansion chamber and 2) an outer surface that faces the outside, wherein the inner surface of the nozzle portion comprises a protruding section and a non-protruding section, and wherein the nozzle portion comprises 1) a first nozzle that extends from the protruding section of the inner surface to the outer surface and 2) a second nozzle that extends from the non-protruding section of the inner surface to the outer surface, wherein the first nozzle and the second nozzle are configured to eject the foaming content introduced into the expansion chamber to outside, wherein each of the first nozzle and the second nozzle comprises 1) a delivery port, 2) an ejection port, and 3) a communication path that extends between the delivery port and the ejection port, and wherein the delivery port is disposed on the inner surface of the nozzle portion and the ejection port is disposed on the outer surface of the nozzle portion such that the foaming content introduced into the expansion chamber is ejected outside through the delivery port, the communication path, and the ejection port.

15. The ejection member as recited in claim 14, wherein a tip end surface of each of the first nozzle and the second nozzle is inclined with respect to an ejection direction of the foaming content.

16. The ejection member as recited in claim 15, wherein the first nozzle and the second nozzle protrude from the outer surface of the nozzle portion, and wherein an outer surface of a protruding portion of the first nozzle protruding from the outer surface of the nozzle portion and an outer surface of a protruding portion of the second nozzle protruding from the outer surface of the nozzle portion each has a tapered shape that narrows toward the nozzle portion.

17. The ejection member as recited in claim 14, wherein the first nozzle and the second nozzle protrude from the outer surface of the nozzle portion, and wherein a first height of a protruding portion of the first nozzle protruding from the outer surface of the nozzle portion differs from a second height of a protruding portion of the second nozzle protruding from the outer surface of the nozzle portion.

18. The ejection member as recited in claim 17, wherein the first height of the first nozzle differs from the second height of the second nozzle such that one of the first height and the second height disposed closer to a center of the nozzle portion than another one of the first height and the second height is shorter than the another one of the first height and the second height.

19. The ejection member as recited in claim 14, wherein the ejection port has a slit-shape that curves in a direction orthogonal to the ejection direction of the foaming content.

20. The ejection member as recited in claim 14, wherein the first nozzle and the second nozzle are spirally arranged.

21. The ejection member as recited in claim 14, wherein the first nozzle and the second nozzle are arranged radially adjacent to each other, and wherein a gap is provided between radially adjacent the first nozzle and the second nozzle.

22. The ejection member as recited in claim 14, wherein the first nozzle and the second nozzle protrude from the outer surface of the nozzle portion, wherein a protruding portion of the first nozzle protruding from the outer surface of the nozzle portion has a first height, wherein a protruding portion of the second nozzle protruding from the outer surface of the nozzle portion has a second height, and wherein the first height of the first nozzle is lower is second height of the second nozzle.

23. The ejection member as recited in claim 14, wherein the expansion chamber is partitioned into a first partitioned space and a second partitioned space, wherein the base portion comprises a second introduction port, wherein the first partitioned space is provided with the first introduction port and the delivery port of the first nozzle, and wherein the second partitioned space is provided with the second introduction port and the delivery port of the second nozzle.

24. The ejection member as recited in claim 14, wherein a central axis of the nozzle portion is shifted from a central axis of a connecting portion of the base portion to connect the body to a stem of the aerosol container.

25. An aerosol product comprising:

the aerosol container filled with the foaming content; and the ejection member as recited in claim 14 attached to the aerosol container.

26. The ejection member as recited in claim 14, wherein an area around the introduction port is mortar shaped.

* * * * *